US006824845B2

(12) United States Patent
Wachi et al.

(10) Patent No.: US 6,824,845 B2
(45) Date of Patent: Nov. 30, 2004

(54) MULTICOLOR IMAGE-FORMING MATERIAL AND METHOD FOR FORMING MULTICOLOR IMAGE

(75) Inventors: Naotaka Wachi, Shizuoka (JP); Akira Hatakeyama, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 168 days.

(21) Appl. No.: 10/060,192

(22) Filed: Feb. 1, 2002

(65) Prior Publication Data

US 2003/0044584 A1 Mar. 6, 2003

(30) Foreign Application Priority Data

| | | |
|---|---|---|
| Feb. 2, 2001 | (JP) | P.2001-027326 |
| Mar. 19, 2001 | (JP) | P.2001-078530 |
| Mar. 19, 2001 | (JP) | P.2001-079221 |
| Jan. 29, 2002 | (JP) | P.2002-019439 |

(51) Int. Cl.[7] ..... B41M 5/40

(52) U.S. Cl. ..... 428/32.81; 428/32.39; 428/32.5; 428/32.52; 428/32.75; 428/32.76

(58) Field of Search ..... 428/32.39, 32.5, 428/32.52, 32.75, 32.76, 32.81, 32.77

(56) References Cited

U.S. PATENT DOCUMENTS

| | | | |
|---|---|---|---|
| 5,053,381 | A | 10/1991 | Chapman et al. |
| 5,126,760 | A | 6/1992 | DeBoer |
| 5,300,398 | A | 4/1994 | Kaszczuk |
| 5,512,931 | A | 4/1996 | Nakajima et al. |
| 5,580,693 | A | 12/1996 | Nakajima et al. |
| 5,593,808 | A | 1/1997 | Ellis |
| 5,611,881 | A | 3/1997 | Kimura et al. |
| 6,027,850 | A | 2/2000 | Kawakami et al. |

FOREIGN PATENT DOCUMENTS

| | | |
|---|---|---|
| JP | 61-123592 | 6/1986 |
| JP | 6-55867 | 3/1994 |
| JP | 6-99675 | 4/1994 |
| JP | 8-197862 | 8/1996 |
| JP | 10-16395 | 1/1998 |
| JP | 2000-158833 | 6/2000 |
| JP | 2000-225776 | 8/2000 |
| JP | 2000-355177 | 12/2000 |

*Primary Examiner*—Bruce H. Hess
(74) *Attorney, Agent, or Firm*—Sughrue Mion, PLLC

(57) ABSTRACT

A multicolor image-forming material which comprises an image-receiving sheet comprising a support having thereon a coating layer including at least an image-receiving layer, and a plurality of heat transfer sheets each comprising a support having coating layers including at least a light-to-heat converting layer and an image-forming layer, wherein the ratio of the optical density (OD) of the image-forming layer in each heat transfer sheet to the layer thickness, OD/layer thickness ($\mu$m unit), is 1.50 or more, the recording area of a multicolor image of the heat transfer sheet is 515 mm or more multiplying 728 mm or more, the definition of a transferred image is 2,400 dpi or more, the coating layer in the image-receiving sheet and/or the coating layers in each heat transfer sheet has at least one layer containing a dispersant and a matting layer having an average particle size of from 0.05 to 50 $\mu$m, and the coating layer further contains, if necessary, prescribed specific spherical fine particles and/or a prescribed specific spherical acryl-based polymer.

21 Claims, 4 Drawing Sheets

MULTICOLOR IMAGE-FORMING MATERIAL AND METHOD FOR FORMING MULTICOLOR IMAGE

FIELD OF THE INVENTION

The present invention relates to a multicolor image-forming material for forming a full color image of high definition with a laser beam, and a method for forming a multicolor image. In particular, the present invention relates to a multicolor image-forming material which is useful for forming a color proof (DDCP: direct digital color proof) or a mask image from digital image signals by laser recording in the field of printing, and a method for forming a multicolor image.

BACKGROUND OF THE INVENTION

In the field of graphic arts, printing of a printing plate is performed with a set of color separation films formed from a color original by a lith film. In general, color proofs are formed from color separation films before actual printing work for checking an error in the color separation step and the necessity for color correction. Color proofs are desired to realize high definition which makes it possible to surely reproduce a half tone image and have performances such as high stability of processing. Further, for obtaining color proofs closely approximating to an actual printed matter, it is preferred to use materials which are used in actual printing as the materials for making color proofs, e.g., the actual printing paper as the base material and pigments as the coloring materials. As the method for forming a color proof, a dry method not using a developing solution is strongly desired.

As the dry method for forming color proofs, a recording system of directly forming color proofs from digital signals has been developed with the spread of electronized system in preprocessing of printing (pre-press field) in recent years. Such electronized system aims at forming in particular high image quality color proofs, generally reproduces a dot image of 150 lines/inch or higher. For recording a proof of high image quality from digital signals, laser beams capable of modulation by digital signals and capable of finely diaphragming recording light are used as recording heads. Therefore, the development of an image-forming material having high recording sensitivity to laser beams and exhibiting high definition property capable of reproducing highly minute dots is required.

As the image-forming material for use in a transfer image-forming method using laser beams, a heat fusion transfer sheet comprising in the order of a support having a light-to-heat converting layer which absorbs laser beams and generates heat, and an image-forming layer which contains a pigment dispersed in components such as a heat fusion type wax and a binder is known (JP-A-5-58045 (the term "JP-A" as used herein means an "unexamined published Japanese patent application")). In the image-forming method using such an image-forming material, an image-forming layer corresponding to the area of a light-to-heat converting layer irradiated with laser beams is fused by heat generated in that area and transferred onto an image-receiving sheet arranged on the transfer sheet by lamination, thus a transferred image is formed on the image-receiving sheet.

Further, a heat transfer sheet comprising a support having provided thereon a light-to-heat converting layer containing a light-to-heat converting material, an extremely thin heat-peeling layer (from 0.03 to 0.3 $\mu$m), and an image-forming layer containing a coloring material in this order is disclosed in JP-A-6-219052. In this heat transfer sheet, the bonding strength between the image-forming layer and the light-to-heat converting layer bonded through the intervening heat-peeling layer is reduced by laser beam irradiation, as a result, a highly minute image is formed on an image-receiving sheet arranged on the heat transfer sheet by lamination. The image-forming method by the heat transfer sheet utilizes so-called ablation, specifically the heat-peeling layer partially decomposes at the area irradiated with laser beams and vaporizes, thereby the bonding strength of the image-forming layer and the light-to-heat converting layer at that area is reduced and the image-forming layer at that area is transferred to the image-receiving sheet laminated thereon.

These image-forming methods have various advantages that an actual printing paper provided with an image-receiving layer (an adhesion layer) can be used as the material of an image-receiving sheet, and a multicolor image can be easily obtained by transferring images different in colors in sequence on the image-receiving sheet. In particular, the image-forming method utilizing ablation has the advantage that highly minute image can be easily obtained, and so these methods are useful for forming a color proof (DDCP: direct digital color proof) or a highly minute mask image.

DTP is prevailing more and more and the intermediate process using films is omitted when CTP (computer to plate) is used, and the need for proof is shifting from analog proof to DDCP. In recent years the demand for large sized high grade DDCP highly stable and excellent in coincidence in printing has increased.

High definition printing can be effected according to a heat transfer method by laser irradiation, and as the laser heat transfer methods, (1) a laser sublimation method, (2) a laser ablation method, and (3) a laser fusion method are conventionally used, but any of these methods has a drawback such that the shape of a recorded dots are not sharp. In (1) a laser sublimation method, since dyes are used as the coloring material, the approximation of proofs to printed matters is not sufficient, further, since this is a method of sublimating coloring materials, the outline of a dot is fuzzy, and so definition is not sufficiently high. On the other hand, since pigments are used as the coloring materials in (2) a laser ablation method, the approximation to printed matters is good, but since this is a method of sputtering coloring materials, the outline of a dot is also fuzzy as in the sublimation method, and so definition is not sufficiently high. Further, in (3) a laser fusion method, a molten substance flows, and so the outline of a dot is not also clear.

Moreover, these image-forming materials comprising a heat transfer sheet and an image-receiving sheet contain a matting agent in the constituting layers to improve the quality of the image to be obtained, but there is such a problem that the contact of the heat transfer sheet and the image-receiving sheet becomes insufficient partially at recording time due to the cohesion of the matting agent, which hinders transferring and causes so-called spot-like image blank areas (i.e., clear spots). Further, the pot life of a coating solution containing a matting agent is relatively short and inconvenient.

SUMMARY OF THE INVENTION

Accordingly, the object of the present invention is to solve the above-described problems of the prior art technique and to accomplish the following objects. That is, an object of the present invention is to provide a large sized high grade DDCP which has high quality and is highly stable and excellent in coincidence in printing. Specifically, the present invention is characterized in that: 1) a heat transfer sheet can provide excellent sharpness of dots and stability by transfer of a membrane of coloring material, which is not influenced by light sources of illumination as compared with the pigment material and the printed matter, 2) an image-receiving sheet can receive stably and surely the image-forming layer in a heat transfer sheet by laser energy, 3) transfer to actual printing paper can be effected corresponding to the range of at least from 64 to 157 g/m$^2$ such as art paper (coat paper), mat paper and finely coated paper, delicate texture can be imaged, and a high-key part can be reproduced accurately, and 4) extremely stable transfer pealing property can be obtained.

A further object of the present invention is to provide a method for forming a multicolor image which can form an image having good image quality and stable transfer image density on an image-receiving sheet even when recording is performed by multi-beam laser beams of high energy under different temperature and humidity conditions.

Still further object of the present invention is to provide an image-forming material capable of using a coating solution having a long pot life and not accompanied by the blank area (i.e., the clear spot) of an image resulting from a matting agent, and a producing method of such a material.

That is, the present invention has been attained by the following means.

(1) A multicolor image-forming material which comprises an image-receiving sheet comprising a support having thereon a coating layer including at least an image-receiving layer, and a plurality of heat transfer sheets each comprising a support having coating layers including at least a light-to-heat converting layer and an image-forming layer, wherein the ratio of the optical density (OD) of the image-forming layer in each heat transfer sheet to the layer thickness, OD/layer thickness ($\mu$m unit), is 1.50 or more, the recording area of a multicolor image of the heat transfer sheet is a size of 515 mm or more multiplying 728 mm or more, the definition of a transferred image is 2,400 dpi or more, and the coating layer in the image-receiving sheet and/or the coating layers in each heat transfer sheet has at least one layer containing a dispersant and a matting agent having an average particle size of from 0.05 to 50 $\mu$m.

(2) The multicolor image-forming material as described in the above item (1), wherein the dispersant is a surfactant and/or a polymer.

(3) The multicolor image-forming material as described in the above item (1) or (2), wherein the average particle size of the matting agent is from 0.1 to 30 $\mu$m.

(4) A method for manufacturing the multicolor image-forming material as described in the above item (1), (2) or (3) which comprises the steps of dispersing the matting agent in a dispersion medium with the dispersant in advance to prepare a coating solution containing the dispersed matting agent, coating and drying the prepared coating solution to form the layer containing the matting agent, to thereby obtain the multicolor image-forming material.

(5) The method for manufacturing the multicolor image-forming material as described in the above item (4), wherein the water content in the dispersion medium at dispersing the matting agent is 50% or less.

(6) The multicolor image-forming material as described in the above item (1), wherein any coating layer in the heat transfer sheet and/or the image-receiving sheet contains spherical fine particles having an average particle size of from 0.10 to 3.0 $\mu$m and a particle size distribution ($L_{25}/L_{75}$) of 2.0 or less.

(7) The multicolor image-forming material as described in the above item (6), wherein the spherical fine particles are amorphous fine particles.

(8) The multicolor image-forming material as described in the above item (6) or (7), wherein the spherical fine particles have an average particle size of from 1.1 to 3.0 $\mu$m.

(9) The multicolor image-forming material as described in the above item (6), (7) or (8), wherein the spherical fine particles have a specific gravity of from 1.1 to 3.5 at 25° C.

(10) The multicolor image-forming material as described in the above item (6), (7), (8) or (9), wherein the spherical fine particles have a specific gravity of from 1.1 to 1.4 at 25° C.

(11) The multicolor image-forming material as described in the above item (1) or (16), wherein any coating layer in either the heat transfer sheet or the image-receiving sheet contains an acryl-based polymer having a glass transition point of from 10 to 120° C.

(12) The multicolor image-forming material as described in the above item (11), wherein the light-to-heat converting layer in the heat transfer sheet contains an acryl-based polymer having a glass transition point of from 10 to 120° C.

(13) The multicolor image-forming material as described in the above item (11) or (12), wherein the acid value of the acryl-based polymer is 300 or less.

(14) The multicolor image-forming material as described in the above item (11), (12) or (13), wherein the acryl-based polymer has structure containing a styrene derivative moiety in the polymer molecule.

(15) The multicolor image-forming material as described in any of the above items (1) to (14), wherein the definition of a transferred image is 2,600 dpi or more.

(16) The multicolor image-forming material as described in any of the above items (1) to (15), wherein the ratio of the optical density (OD) of the image-forming layer in each heat transfer sheet to the layer thickness, OD/layer thickness ($\mu$m unit), is 1.80 or more.

(17) The multicolor image-forming material as described in any of the above items (1) to (16), wherein the recording area of a multicolor image is 594 mm multiplying 841 mm or more.

(18) The multicolor image-forming material as described in any of the above items (1) to (17), wherein the contact angle of the image-forming layer in each heat transfer sheet and the image-receiving layer in the image-receiving sheet with water is from 7.0 to 120.0°.

(19) The multicolor image-forming material as described in any of the above items (1) to (18), wherein the ratio of the optical density (OD) of the image-forming layer in each heat transfer sheet to the layer thickness, OD/layer thickness ($\mu$m unit), is 1.80 or more, and the contact angle of the image-receiving sheet with water is 89° or less.

(20) The multicolor image-forming material as described in any of the above items (1) to (18), wherein the ratio of the optical density (OD) of the image-forming layer in each heat transfer sheet to the layer thickness, OD/layer thickness ($\mu$m unit), is 2.50 or more.

(21) A method for forming a multicolor image using the image-receiving sheet as described in any of the above items (1) to (20) and four or more heat transfer sheets as described in any of the above items (1) to (20) comprising the steps of superposing the image-forming layer in each heat transfer sheet and the image-receiving layer in the image-receiving sheet vis-a-vis, and irradiating the heat transfer sheet from the support side with laser beams and transferring the area of the image-forming layer subjected to laser beam irradiation onto the image-receiving layer in the image-receiving sheet, to thereby effect image-recording, wherein the image-forming layer in the laser beam irradiation area is transferred to the image-receiving sheet in a membrane state.

Figure 1:
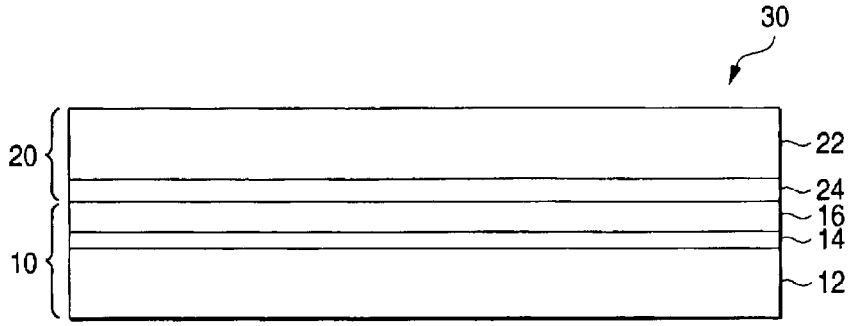
FIG. 1 is a drawing showing the outline of the scheme of multicolor image-forming by membrane heat transfer (i.e., thin film heat transfer) by irradiation with a laser.
Figure 1:
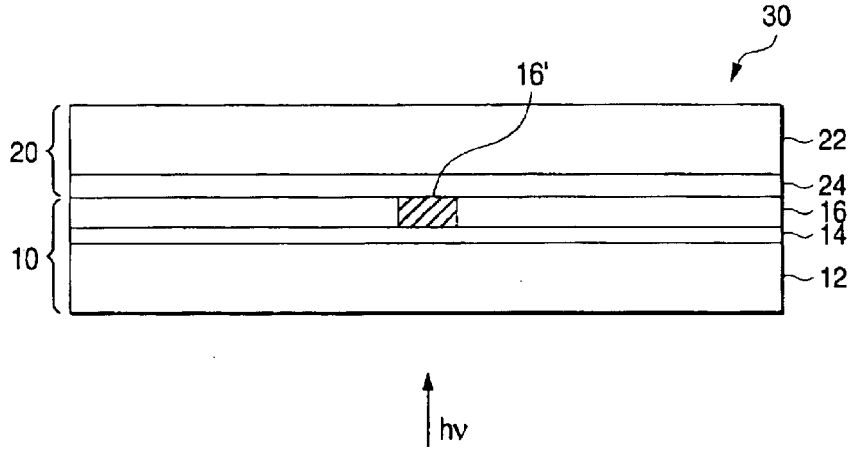
Figure 1:
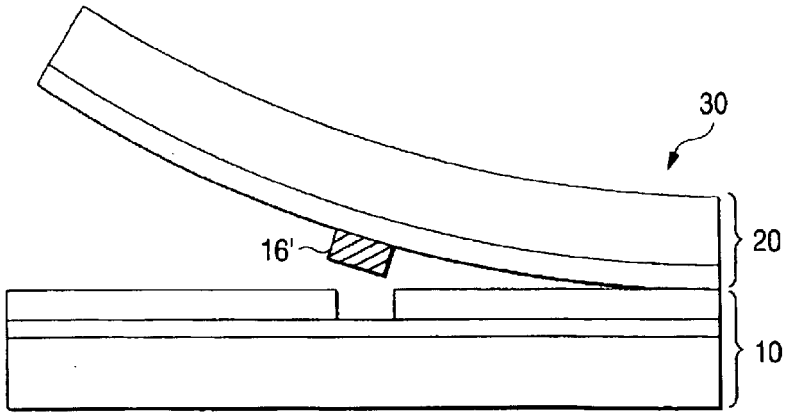

DESCRIPTION OF REFERENCE CHARACTERS:

1: Recording unit
2: Recording head
3: Subsidiary scanning rail
4: Recording drum
5: Heat transfer sheet-loading unit
6: Image-receiving sheet roll
7: Carrier roller
8: Squeeze roller
9: Cutter
10: Heat transfer sheet
10K, 10C, 10M, 107: Heat transfer sheet rolls
12: Support
14: Light-to-heat converting layer
16: Image-forming layer
20: Image-receiving sheet
22: Support for image-receiving sheet
24: Image-receiving layer
30: Laminate
31: Discharge-receiving table
32: Discard port
33: Discharge port
34: Air
35: Discard box
42: Actual paper
43: Heat roller
44: Insert-receiving table
45: Mark showing the position of placement
46: Insert roller
47: Guide made of heat resisting sheet
48: Peeling claw
49: Guide plate
50: Discharge port

DETAILED DESCRIPTION OF THE INVENTION

As a result of eager investigation to provide a B2/A2 to B1/A1 or larger sized high grade DDCP which is highly stable and excellent in coincidence in printing, the present inventors have developed a heat transfer recording system by laser irradiation for DDCP which comprises an image-forming material of a B2 or larger size having performances of transfer to actual printing paper, reproduction of actual dots and of a pigment type, output driver, and high grade CMS software.

The characteristics of the heat transfer recording system by laser irradiation which has been developed by the present inventors, the constitution of the system and the outline of technical points are as follows. As the characteristics of performances, (1) since the dot shapes are sharp, dots which are excellent in approximation to the printed matter can be reproduced, (2) the approximation of hue to the printed matter is good, and (3) since the recorded quality is hardly influenced by the surrounding temperature and humidity and repeating reproducibility is good, a stable proof can be formed. The technical points of the material capable of obtaining such characteristics of performances are the establishment of the technique of membrane transfer (i.e., thin film transfer), and the improvement of the retentivity of vacuum adhesion of the material required of a laser heat transfer system, following up of high definition recording, and the improvement of heat resistance. Specifically, (1) thinning of a light-to-heat converting layer by the introduction of an infrared absorbing dye, (2) strengthening of the heat resistance of a light-to-heat converting layer by the introduction of a polymer having a high Tg, (3) stabilization of hue by the introduction of a heat resisting pigment, (4) control of the adhesive strength and the cohesive strength of the material by the addition of low molecular weight components, such as a wax and an inorganic pigment, and (5) the provision of vacuum adhesion property to the material not being accompanied by the deterioration of an image quality by the addition of a matting agent to a light-to-heat converting layer, can be exemplified. As the technical points of the system, (1) carrying by air for continuous accumulation of multi sheets of films in a recording unit, (2) insert of a heat transfer unit on an actual paper for reducing curling after transfer, and (3) connection of output driver of a wide use having system connecting expendability, can be exemplified. The laser irradiation heat transfer recording system developed by the present inventors consists of diverse characteristics of performances, system constitution and technical points as described above, but these are exemplifications and the present invention is not limited thereto.

The present inventors have performed development on the basis of thoughts that individual material, each coating layer such as a light-to-heat converting layer, a heat transfer layer and an image-receiving layer, and each heat transfer sheet and image-receiving sheet are not present individually separately but they must function organically and synthetically, further these image-forming materials exhibit the highest possible performances when combined with a recording unit and a heat transfer unit. The present inventors have sufficiently examined each coating layer and the constituting materials of an image-forming material and prepared each coating solution bringing out the best of their characteristics to make the image-forming material, and found proper ranges of various physical properties so that the image-forming material can exhibit the best performance. As a result, the relationships between each material, each coating layer and each sheet with the physical properties have been investigated thoroughly, and by functioning them organically and synthetically with the recording unit and the heat transfer unit, a high performance image-forming material could be found unexpectedly. The present invention is important since the positioning of the present invention is directly related to the system developed by the present inventors as the introduction of a matting agent to coating layers such as a light-to-heat converting layer, an image-forming layer, an image-receiving layer and a backing layer. The present invention applies a matting agent to the image-forming material having the ratio of the optical density (OD) of the image-forming layer in each heat transfer sheet to the layer thickness, OD/layer thickness ($\mu$m unit), of 1.50 or more, the recording area of a multicolor image of each heat transfer sheet of a size of 515 mm or more multiplying 728 mm or more, and the definition of a transferred image of 2,400 dpi or more.

The multicolor image-forming material according to the present invention (hereinafter also simply referred to as an image-forming material) comprises an image-receiving sheet and a plurality of heat transfer sheets. One or more matting agent-containing layers are provided in the coating layers in the image-receiving sheet and/or each heat transfer sheet.

In the present invention, the ratio of the optical density (OD) of the image-forming layer to the layer thickness, OD/layer thickness ($\mu$m unit), is the ratio of the optical density of the image-forming layer to the layer thickness of the image-forming layer measured in $\mu$m unit. The optical density is the reflection optical density obtained by transferring the image having been transferred from a heat transfer sheet to an image-receiving sheet further to Tokuryo art paper, and measuring by color mode of each color such as yellow (Y), magenta (M), cyan (C) or black (K) with a densitometer (X-rite 938, manufactured by X-rite Co.). The layer thickness of the image-forming layer is measured by observing the cross section of the heat transfer sheet before image-recording with a scanning electron microscope. In the present invention, an image having high optical density and good definition can be obtained by making OD/layer thickness ($\mu$m unit) 1.5 or more. When the OD/layer thickness is less than 1.5, sufficient optical density cannot be obtained or definition lowers, a good image cannot be obtained in either case.

The present invention also concerns the multicolor image-forming material in which the recording area of a multicolor image of each heat transfer sheet is a large size of 515 mm or more multiplying 728 mm or more, and the definition of a transferred image is high definition of 2,400 dpi or more.

In the present invention as described above, one or more layers containing a matting agent having an average particle size of from 0.05 to 50 $\mu$m are provided in the coating layers in the image-receiving sheet and/or each heat transfer sheet. The layers containing a matting agent and the forming method of the layers are described below.

(1) Matting agent

In the present invention, the matting agent comprises solid particle and used to make the surface of the image-receiving sheet or the heat transfer sheet uneven. Here, pigments which are mainly used for displaying images are excluded from the solid particles. The matting agent is preferably substantially colorless.

The matting agents for use in the present invention are not particularly limited as to the material and the shape so long as they have an average particle size of from 0.05 to 50 $\mu$m. As the material, inorganic and organic fine particles can be exemplified. The examples of the inorganic fine particles include metal salts, e.g., silica, titanium oxide, aluminum oxide, zinc oxide, magnesium oxide, barium sulfate, magnesium sulfate, aluminum hydroxide, magnesium hydroxide and boron nitride, kaolin, clay, talc, zinc flower, lead white, zeeklite, quartz, diatomaceous earth, pearlite, bentonite, mica, and synthetic mica. The examples of the organic fine particles include olefin resins, e.g., polystyrene and polyethylene, acryl resin particles, e.g., fluorine resin particles, guanamine resin particles, and polymethyl methacrylate, styrene-acryl copolymer resin particles, silicone resin particles, melamine resin particles and epoxy resin particles. Of these fine particles, in the case of polymer matting agents, so-called three dimensional network structure by crosslinking for preventing dissolution due to the solvent in a coating solution is also preferably used. Of the above compounds, matting agents of inorganic compounds are particularly preferred, because swelling and subsequent deformation due to the solvent in a coating solution is difficult to occur.

The shape of the matting agent is not especially restricted and spherical, irregular and cubic shapes can be used.

The matting agents for use in the present invention generally have an average particle size of from 0.05 to 50 $\mu$m, preferably from 0.1 to 30 $\mu$m, and more preferably from 0.3 to 15 $\mu$m. The average particle size of the matting agent can be obtained, e.g., by photographing the particles with a scanning electron microscope.

The addition amount of the matting agent is generally from 0.1 to 100 $\mu g/m^2$, preferably from 1 to 70 $mg/m^2$.

(2) Layer Containing Matting Agent

The coating layer of the heat transfer sheet of the present invention comprises at least a light-to-heat converting layer and an image-forming layer on a support but, if necessary, a peeling layer and an image-protective layer may be provided besides these layers. The matting agent of the present invention may be added to any of these layers but the matting agent is particularly preferably added to a light-to-heat converting layer.

The coating layer of the image-receiving sheet of the present invention comprises at least an image-receiving layer on a support but, if necessary, a cushioning layer may be provided. The matting agent of the present invention may be added to any of these layers, but the matting agent is particularly preferably added to a cushioning layer.

The thickness, binder and other additives of the layers containing the matting agent are not particularly restricted. For example, the thickness is preferably from 0.05 to 40 $\mu$m, preferably from 0.1 to 30 $\mu$m. As the binders, a polyurethane resin, an epoxy resin, a polyvinyl butyral resin, a vinyl acetate resin, polyvinyl chloride acetate resin can be exemplified.

(3) Dispersion Method of Matting Agent and Dispersant

A matting agent-containing layer is formed by coating a coating solution containing a matting agent and drying. At this time, it is preferred that a matting agent is dispersed in advance in the presence of a dispersant. The terminology "dispersion" used herein means the state that the matting agent is not cohered to each other and uniformly suspended in a dispersion medium as a liquid. With respect to dispersion, e.g., Takao Karikomi, Masumi Koishi and Tohru Hidaka compiled, *Nyuka-Bunsan Gijutsu Ohyo Handbook* (*Handbook of Technical Applications of Emulsification and Dispersion*), Science Forum Co., Ltd. (1987), and Toshio Kajiuchi and Hiroki Usui compiled, *Bunsan-kei Rheology to Bunsanka Gijutsu* (*Rheology of Dispersion System and Techniques of Dispersion*), Shinzan-Sha Publishing Co., Ltd. (1991) can be referred to.

As the method of dispersing a matting agent in a dispersion medium, generally a method of mixing a matting agent with a dispersant and applying external force, e.g., shearing force, but in the present invention, a dispersant is further added to a matting agent and a dispersion medium. A dispersion method is not particularly limited and a ball mill and a paint shaker are used. With respect to dispersion, the above *Nyuka-Bunsan Gijutsu Ohyo Handbook*, p. 466 and the above *Bunsan-kei Rheology to Bunsanka Gijutsu*, p. 357 can be referred to.

Well-known dispersants can be used in the present invention. The specific examples of dispersants include surfactants and polymers including oligomers. The examples of surfactants include anionic surfactants, e.g., sodium alkylbenzenesulfonates and sodium alkylsulfates, cationic surfactants, e.g., alkylpyridinium chlorides and alkylpyridinium bromides, and nonionic surfactants, e.g., polyoxyethylenealkylphenols and polyoxyethylene fatty acid esters. In addition, betaine surfactants having both positive and negative electric charges in the molecule can also be used. Natural products, e.g., saponin, can also be used as surfactant. Surfactants are described, e.g., in Tokiyuki Yoshida, Shinichi Shindo, Tadayoshi Ohgaki and Kiyoshi Nakayama compiled, *Kaimen Kasseizai Handbook* (*Handbook of Surfactants*), Kogaku Tosho Shuppan Co., Ltd. (1987).

The examples of the polymers include polyvinyl alcohol, polyacrylamide, sodium polyacrylate, polyethylene oxide and derivatives of it, polyacrylate and copolymers of it, cellulose and derivatives of it, starch and derivatives of it, protein and derivatives of it, and natural polysaccharide and derivatives of it. Since the kind of preferred polymer varies according to the kind of the matting agent and the dispersant, and so cannot be said unconditionally, but when the dispersion medium is water, polyvinyl alcohol, cellulose and derivatives of it are preferably used, and when the dispersion medium is an organic solvent, polyacrylic ester and a copolymer of it, polyethylene oxide and derivatives of it are preferably used. The molecular weight of the polymers is preferably from 200 to 500,000 or so, more preferably from 500 to 100,000 or so.

(4) Dispersion Medium

The dispersion medium is not particularly restricted, and well-known dispersion medium, e.g., methyl ethyl ketone, methyl isobutyl ketone, ethyl acetate, butyl acetate, methyl alcohol, ethyl alcohol, n-propyl alcohol, i-propyl alcohol and N-methylpyrrolidone can be used. These compounds may be used alone or as mixture. The examples of use as mixture include methyl ethyl ketone/n-propyl alcohol (50/50), methyl ethyl ketone/n-propyl alcohol (80/20), methyl ethyl ketone/n-propyl alcohol (20/80), methyl ethyl ketone/methyl alcohol (50/50), methyl ethyl ketone/methyl isobutyl ketone (90/10), ethyl acetate/butyl acetate (80/20), ethyl acetate/methyl alcohol (40/60), methyl ethyl ketone/N-methylpyrrolidone (50/50), methyl ethyl ketone/N-methylpyrrolidone (80/20), and methyl ethyl ketone/N-methylpyrrolidone (20/80). The dispersion medium may contain water. As such examples, methyl alcohol/water (90/10) and methyl ethyl ketone/water (95/5) can be exemplified (the numbers in parentheses means the mass (i.e., the weight) of each component). The content of water in a dispersion medium is preferably 50% or less, particularly preferably 30% or less.

(5) Coating method

The matting agent-containing layer of the present invention maybe coated by well-known methods without limitation. Well-known coaters, e.g., a bar coater, a spin coater, and a slide coater can be used.

In one embodiment of the image-forming material of the present invention, prescribed spherical fine particles are added to any coating layer of the heat transfer sheet and/or the image-receiving sheet, and the spherical fine particles contained in the coating layer are effective for enhancing vacuum drawing.

That is, in the image-forming material of the present invention, image-recording is performed by irradiation of laser beams with the heat transfer sheet and the image-receiving sheet being superposed vis-a-vis. If the gap between the heat transfer sheet and the image-receiving sheet is too big at this time, membrane transfer is not effected satisfactorily and a good image cannot be obtained. Accordingly, a vacuum drawing is generally performed before image formation in image-recording to heighten the adhesion of the heat transfer sheet and the image-receiving sheet.

In one embodiment of the image-forming material of the present invention, certain spherical fine particles are added to any coating layer of the heat transfer sheet and/or the image-receiving sheet, and the spherical fine particles contained in the coating layer are extremely effective for enhancing the effect of vacuum drawing. When the spherical fine particles of the present invention are added to the coating layers and at the same time OD/layer thickness ($\mu$m unit) is made 1.5 or more, a very good image can be obtained. In particular, when an image area is large, the effect of vacuum drawing is liable to lower, the combination of using the spherical fine particles of the present invention and making OD/layer thickness ($\mu$m unit) 1.5 or more is effective in the case of an image of an area of 515 mm or more multiplying 728 mm or more.

The spherical fine particles in the present invention are determined as follows. A particle is photographed by a scanning electron microscope of 10,000 magnifications, the longest particle L1 and L2 which is the diameter of a circle having the same area as the particle are measured, and L2/L1 is computed. L2/L1 is computed with one hundred fine particles, and when La, which is the average value of L2/L1, is 0.8 or more, the particles are "spherical". La of the spherical fine particles for use in one embodiment of the present invention is 0.8 or more, more preferably 0.85 or more. When fine particles having L2/L1 of less than 0.8 are used, there arises a problem that the scratch strength of the multicolor image-forming material of the present invention is deteriorated.

The average particle diameter of the spherical fine particles used in the present invention is the average value Lb of L2 of one hundred fine particles. The average particle diameter of the spherical fine particles for use in one embodiment of the present invention is from 0.10 to 3.0 $\mu$m, more preferably from 1.1 to 3.0 $\mu$m. When fine particles having an average particle diameter of less than 0.1 $\mu$m are used, the effect of the addition is not sufficient, while when it exceeds 3.0 $\mu$m, there arises a problem of the precipitation of the fine particles in a coating solution.

The particle size distribution of the spherical fine particles in the present invention is represented by the ratio of the average of high ranking 25 particles $L_{25}$ of L2 to the average of high ranking 75 particles $L_{75}$, $L_{25}/L_{75}$, measured with 100 fine particles. $L_{25}/L_{75}$ of the spherical fine particles for use in one embodiment of the present invention is preferably 2.0 or less, more preferably 1.5 or less. When $L_{25}/L_{75}$ exceeds 2, since fine particles having a big particle diameter are present, there arises a problem of the precipitation of the fine particles in a coating solution similarly to the case where the average diameter of the fine particles is large.

As the spherical fine particles, either inorganic or organic fine particles can be used. The examples of the inorganic fine particles include fine particles of metal salts, e.g., silica, titanium oxide, aluminum oxide, zinc oxide, magnesium oxide, barium sulfate, magnesium sulfate, aluminum hydroxide, magnesium hydroxide and boron nitride, kaolin, clay, talc, zinc flower, lead white, zeeklite, quartz, diatomaceous earth, pearlite, bentonite and mica. The examples of the organic fine particles include fine particles of fluorine resin, guanamine resin, acrylate resin, silicone resin, epoxy resin, styrene resin, and copolymers of these resins.

Of these fine particles, fine particles having a specific gravity of preferably from 1.1 to 3.5, more preferably from 1.1 to 1.4, and amorphous particles are particularly preferably used.

In one embodiment of the multicolor image-forming material of the present invention, these spherical fine particles are added to either or both coating layer (s) of the heat transfer sheet and/or the image-receiving sheet in an amount of from 1 to 100 $mg/m^2$, more preferably from 2 to 70 $mg/m^2$, per a sheet. When the addition amount is little, the effect of addition is insufficient, while when the amount is too much, there arises a drawback that the quality of the image obtained is deteriorated.

In one embodiment of the image-forming material of the present invention, a definite acryl-based polymer is contained in any coating layer in either the heat transfer sheet and/or the image-receiving sheet, and this acryl-based polymer contained in a coating layer has the effect of improving the definition of a transferred image.

That is, in the laser heat transfer recording system developed by the present inventors, the definition of an image is very important for representing characters and fine lines in high quality. When the definition of an image is inferior, characters and lines are jagged and difficult to read or lines are broken halfway. As the means for improving the definition of a transferred image, e.g., heightening the ratio of the pigment to the binder (P/B ratio) in the image-forming layer, or adjusting the addition amounts of additives in the image-forming layer, to thereby control the physical properties of the image-forming layer can be exemplified. However, if P/B ratio is increased too much, the dispersion stability of the pigment lowers, and in the adjustment of the physical properties of the image-forming layer, other performances are deteriorated in many cases, e.g., transfer sensitivity is reduced, thus the adjustment does not go well easily and such is the state at present.

As a result of eager investigation by the present inventors of the addition of various additives to the light-to-heat converting layer and the image-receiving layer for improving definition, we have found that the effect of improving the definition of a transferred image can be obtained by adding a small amount of definite acryl-based polymer to either the light-to-heat converting layer of the heat transfer sheet or the image-receiving sheet, thus the embodiment of the addition of a definite acryl-based polymer to the coating layer has been completed.

The acryl-based polymer for use in one embodiment of the present invention preferably has a glass transition point of from 10 to 120° C., more preferably from 30 to 110° C. When the glass transition point is lower than 10° C., the glass transition point of the light-to-heat converting layer itself easily lowers, which causes the degradation of the heat resistance of the light-to-heat converting layer. While when the glass transition point is higher than 120° C., transfer sensitivity lowers in some cases.

The acid value of the acryl-based polymer is preferably 300 or less, more preferably 250 or less. When the acid value of the polymer is too high, the coating layer is liable to be influenced by the surrounding temperature and humidity of laser recording.

When the acryl-based polymer for use in one embodiment of the present invention contains a styrene derivative moiety in the polymer molecule, the improving effect of definition is great for the addition amount and, further, in particular the hue of the cyan image preferably approximates to the printed matter at laser recording time. Specifically, since the generation of coloring components resulting from heat decomposition of a light-to-heat converting agent and the migration of the coloring components to the image-forming layer at laser recording time are inhibited, b* in L*a*b* color specification approximates to the printed matter.

The content of the styrene derivative in the polymer is preferably from 1 to 90%, more preferably from 20 to 80%.

The effect of the addition can be obtained when the acryl-based polymer is added to either the light-to-heat converting layer of the heat transfer sheet or added to image-receiving layer of the image-receiving sheet. However, for obtaining the effect of improving the definition to every color, the acryl-based polymer is more preferably added to the heat transfer sheet.

When the acryl-based polymer is added to the heat transfer sheet, not only the above-described hue is improved but the dispersion stability of the matting agent, which is added to give a vacuum adhesion property, is improved, hence further preferred.

The addition amount of the acryl-based polymer in the present invention varies a little according to the kind of the polymer to be added, but is preferably from 0.01 to 30 mass % of the entire solid content in the layer to be added, more preferably from 0.1 to 20 mass %.

The molecular weight of the acryl-based polymer is not particularly limited. Specifically, from oligomers having a weight average molecular weight of about 1,500 to polymers having a molecular weight of about 50,000 can be used but those having an extremely low molecular weight are liable to be diffused during storage, hence not preferred.

The acryl-based polymer may be added to the light-to-heat converting solution separately as the additive, or may be dispersed with a matting agent and added to the light-to-heat converting solution as the dispersion solution of the matting agent.

As the specific examples of the acryl-based polymers, a styrene/acrylic acid copolymer, a styrene/methacrylic acid copolymer, a styrene/α-methylstyrene/acrylic acid copolymer, a styrene/butyl acrylate/methyl methacrylate copolymer, a styrene/methyl acrylate copolymer, a styrene/methyl methacrylate copolymer, a styrene/α-methylstyrene/methyl methacrylate copolymer, a styrene/α-methylstyrene/ethyl acrylate copolymer, and a styrene/butyl methacrylate can be exemplified, but the present invention is not limited thereto.

In the image-forming material of the present invention, each contact angle with water of the image-forming layer in each heat transfer sheet and the image-receiving layer in the image-receiving sheet is preferably from 7.0 to 120.0°. The contact angle is a barometer of the compatibility of the image-forming layer with the image-receiving layer, i.e., transferability, and the contact angle is more preferably from 30.0 to 100.0°. Further, the contact angle of the image-receiving layer with water is more preferably 89° or less. With the above range of the contact angle, transfer sensitivity can be enhanced and, further, the temperature-humidity dependency of recording characteristics can be decreased.

The contact angle with water of each layer surface in the present invention is the value obtained by measuring by a contact angle meter CA-A type (manufactured by Kyowa Kaimen Kagaku Co., Ltd.).

In the next place, the system at large developed by the present inventors will be described below together with the content of the present invention. In the system of the present invention, high definition and high image quality have been attained by adopting a membrane heat transfer system (i.e., a thin film heat transfer system). The system of the present invention is capable of obtaining a transferred image having definition of 2,400 dip or more, preferably 2,600 dip or more. The heat transfer system by membrane (i.e., by thin film) is a system of transferring a thin image-forming layer having a film thickness of from 0.01 to 0.9 μm to an image-receiving sheet in the state of partially not melting or hardly melting. That is, since the recorded part is transferred as a membrane, an image of extremely high definition can be obtained. A preferred method of efficiently performing membrane heat transfer is to deform the inside of a light-to-heat converting layer to a dome-like form by heat-recording, push up the image-forming layer, to thereby enhance the adhesion of the image-forming layer and the image-receiving layer to make transferring easy. When the deformation is large, transferring becomes easy, since the force of pressing the image-forming layer against the image-receiving layer is great. While when the deformation is small, sufficient transferring cannot be effected in part, since the force of pressing the image-forming layer against the image-receiving layer is small. Deformation preferred for the membrane transfer can be observed by a laser microscope (VK8500, manufactured by Keyence Corporation), and the size of deformation can be evaluated by a deformation factor obtained by dividing [increased cross-sectional area of the recording area of the light-to-heat converting layer after heat recording (a) plus cross-sectional area of the recording area of the light-to-heat converting layer before heat recording (b)] by [cross-sectional area of the recording area of the light-to-heat converting layer before heat recording (b)] and multiplying 100. That is, deformation factor= $[(a+b)/(b)]\times 100$. The deformation factor is generally 110% or more, preferably 125% or more, and more preferably 150% or more. The deformation factor maybe greater than 250% when the breaking elongation is made large but it is preferred to restrict the deformation factor to about 250% or less.

The technical points of the image-forming material in membrane transfer are as follows.

1. Compatibility of High Heat Responsibility and Storage Stability

For obtaining high image quality, transferring of a membrane (i.e., a thin film) of sub-micron order is necessary, but for obtaining desired density, it is necessary to form a layer having dispersed therein a pigment in high concentration, which is reciprocal to heat responsibility. Heat responsibility is also in the relationship reciprocal to storage stability (adhesion). By the development of novel polymer-additive, this reciprocal relationship has been solved.

2. Security of High Vacuum Adhesion

In membrane transfer pursuing high definition, the interface of transfer is preferably smooth, by which, however, sufficient vacuum adhesion cannot be obtained. Vacuum adhesion could be obtained by adding a little much amount of a matting agent having a relatively small particle size to the under layer of the image-forming layer, departing from general knowledge of obtaining vacuum adhesion, with maintaining proper gap uniform between the heat transfer sheet and the image-receiving sheet, without causing clear spots of image and securing the characteristics of membrane transfer.

3. Use of Heat Resisting Organic Material

A light-to-heat converting layer which converts laser beam to heat at laser recording attains the temperature of about 700° C. and an image-forming layer containing pigment materials reaches about 500° C. The present inventors have developed, as the material of a light-to-heat converting layer, modified polyimide capable of coating with an organic solvent, and at the same time pigments which are higher heat resisting than pigments for printing, safe and coincident in hue, as the pigment materials.

4. Security of Surface Cleanliness

In membrane transfer, dust between a heat transfer sheet and an image-receiving sheet causes an image defect, which is a serious problem. There are dust coming from the outside of the apparatus, or generated by cutting of materials, therefore dust cannot be excluded by only material control, and it is necessary that apparatus must be provided with a dust removing device. However, we found a material capable of maintaining appropriate viscosity and capable of cleaning the surface of a transfer material and realized the removal of dust by changing the material of the transfer roller without reducing the productivity.

In the next place, the system at large of the present invention will be described in detail below.

The present invention has realized a heat transfer image having sharp dots and transferring of an image to actual printing paper of a recording size of B2 size or larger (515 mm or more multiplying 728 mm or more). More preferably B2 size is 543 mm multiplying 765 mm (particularly 594 mm multiplying 841 mm), and recording of larger than this size is possible according to the present invention.

One characteristic of the performances of the system of the present invention is that sharp dot shape can be obtained. A heat transfer image obtained by this system is a dot image corresponding to print line number of definition of 2,400 dpi or more. Since individual dot obtained according to this system is very sharp and almost free of blur and chip, dots of a wide range from highlight to shadow can be clearly formed. As a result, output of dots of high grade having the same definition as obtained by an image setter and a CTP setter is possible, and dots and gradation which are excellent in approximation to the printed matter can be reproduced.

The second characteristic of the performances of the system of the present invention is that repeating reproducibility is good. Since a heat transfer image obtained by this system is sharp in dot shape, dots corresponding to laser beam can be faithfully reproduced, further recording characteristics are hardly influenced by the surrounding temperature and humidity, repeating reproducibility stable in hue and density can be obtained under wide temperature humidity conditions.

The third characteristic of the performances of the system of the present invention is that color reproduction is good. A heat transfer image obtained by this system is formed with coloring pigments used in printing inks and since excellent in repeating reproducibility, highly minute CMS (color management system) can be realized.

The heat transfer image by the system of the present invention almost coincided with the hues of Japan color and SWOP color, i.e., the hues of printed matters, and the colors appear similarly to the printed matter even when light sources of illumination are changed, such as a fluorescent lamp, an incandescent lamp.

The fourth characteristic of the performances of the system of the present invention is that the quality of a character is good. Since a heat transfer image obtained by this system is sharp in dot shape, the fine line of a fine character can be reproduced sharply.

The characteristic technical points of the material for use in the system of the present invention are further described in detail below. As the heat transfer methods for DDCP, there are (1) a sublimation method, (2) an ablation method, and (3) a heat fusion method. Methods (1) and (2) are systems using sublimation or sputtering, the outline of a dot becomes fuzzy. On the other hand, in method(3),since a molten substance flows, the outline of a dot is not also clear. On the basis of a membrane transfer technique, the present inventors incorporated the following techniques to the system of the present invention for solving the new problems in laser transfer systems and obtaining further high image quality. The first characteristic of the technique of materials is sharpening of dot shape. Image recording is performed by converting laser beams to heat in a light-to-heat converting layer and conducting the heat to the image-forming layer contiguous to the light-to-heat converting layer, and adhering the image-forming layer to an image-receiving layer. For sharpening dot shape, heat generated by laser beams is not diffused in the surface direction but conducted to the transfer interface, and the image-forming layer ruptures sharply at interface of heating area/non-heating area. The thickness of the light-to-heat converting layer in the heat transfer sheet is thinned and dynamic properties of the image-forming layer are controlled for this purpose.

The first technique of sharpening of dot shape is thinning of the light-to-heat converting layer. The light-to-heat converting layer is presumed from simulation to reach about 700° C. in a moment, and a thin film is liable to be deformed and ruptured. When deformation and rupturing occur, the light-to-heat converting layer is transferred to the image-receiving layer together with the image-forming layer or a transferred image becomes uneven. On the other hand, a light-to-heat converting material must be present in the light-to-heat converting layer in high concentration for obtaining a desired temperature, which results in a problem of precipitation of the light-to-heat converting material or migration of the material to the contiguous layer. Carbon black has been conventionally used in many cases as the light-to-heat converting material, but an infrared absorbing dye is used as the light-to-heat converting material in the present invention which can save the use amount as compared with carbon black. Polyimide compounds having sufficient dynamic strength even at high temperature and high retentivity of an infrared absorbing dye were introduced as the binder.

In this manner, it is preferred to make thin the light-to-heat converting layer up to about 0.5 $\mu$m or less by selecting an infrared absorbing dye excellent in light-to-heat converting property and a heat-resisting binder such as polyimide compounds.

The second technique of sharpening of dot shape is the improvement of the characteristics of an image-forming layer. When a light-to-heat converting layer is deformed or an image-forming layer itself is deformed due to high temperature, thickness unevenness is caused in an image-forming layer transferred to an image-receiving layer corresponding to the subsidiary scanning pattern of laser beams, as a result the image becomes uneven and apparent transfer density is reduced. The thinner the thickness of an image-forming layer, the more conspicuous is this tendency. On the other hand, when the thickness of an image-forming layer is thick, dot sharpness is impaired and sensitivity decreases.

To reconcile these reciprocal properties, it is preferred to improve transfer unevenness by adding a low melting point material to an image-forming layer, e.g., a wax. Transfer unevenness can be improved with maintaining dot sharpness and sensitivity by adding inorganic fine particles in place of a binder to adjust the layer thickness of an image-forming layer properly so that the image-forming layer ruptures sharply at interface of heating area/non-heating area.

In general, materials having a low melting point, such as a wax, are liable to ooze out to the surface of an image-forming layer or to be crystallized and cause a problem in image quality and the aging stability of a heat transfer sheet in some cases.

To cope with this problem, it is preferred to use a low melting point material having no great difference from the polymer of an image-forming layer in an SP (Solubility Parameter) value, by which the compatibility with the polymer can be increased and the separation of the low melting point material from the image-forming layer can be prevented. It is also preferred to mix several kinds of low melting point materials to prevent crystallization by eutectic mixture. As a result, an image showing a sharp dot shape and free of unevenness can be obtained.

The second characteristic of the technique of the materials is that the present inventors found that recording sensitivity has temperature and humidity dependency. The dynamic properties and thermal physical properties of the coated layers of a heat transfer sheet are generally varied by absorbing moisture and the humidity dependency of recording condition is caused.

For reducing the temperature and humidity dependency, it is preferred that the dye/binder system of a light-to-heat converting layer and the binder system of an image-forming layer are organic solvents. Further, it is preferred to use polyvinyl butyral as the binder of an image-receiving layer and to introduce a hydrophobitization technique of polymers for the purpose of lowering water absorption properties of polymers. As the hydrophobitization technique of polymers, the technique of reacting a hydroxyl group with a hydrophobic group, or crosslinking two or more hydroxyl groups with a hardening agent as disclosed in JP-A-8-238858 can be exemplified.

The third characteristic of the technique of the materials is the improvement of the approximation of hue to the printed matter. In addition to color matching of pigments by thermal head system color proof (First Proof, manufactured by Fuji Photo Film Co., Ltd.) and the technique of stable dispersion, a problem newly occurred in the laser heat transfer system was solved. That is, technique 1 of the improvement of the approximation of hue to the printed matter is to use a highly heat resisting pigment. About 500° C. or more heat is generally applied to an image-forming layer by laser exposure imaging, and so some of conventionally used pigments are heat-decomposed, but this problem can be prevented by using highly heat resisting pigments in an image-forming layer.

Technique 2 of the improvement of the approximation of hue to the printed matter is the diffusion prevention of an infrared absorbing material. For preventing the variation of hue due to migration of an infrared absorbing dye from a light-to-heat converting layer to an image-forming layer by high heat at exposure, it is preferred to design a light-to-heat converting layer by combination of an infrared absorbing dye having high retentivity and a binder as described above.

The fourth characteristic of the technique of the materials is to increase sensitivity. Shortage of energy generally occurs in high speed printing and, in particular, time lag is caused in intervals of laser subsidiary-scanning and gaps are generated. As described above, using a dye of high concentration in a light-to-heat converting layer and thinning of a light-to-heat converting layer and an image-forming layer can improve the efficiency of generation and conduction of heat. It is also preferred to add a low melting point material to an image-forming layer for the purpose of slightly fluidizing the image-forming layer at heating to thereby fill the gaps and improving the adhesion with the image-receiving layer. Further, for enhancing the adhesion of the image-receiving layer and the image-forming layer and sufficiently strengthening a transferred image, it is preferred to use polyvinyl butyral used in the image-forming layer as the binder in the image-receiving layer.

The fifth characteristic of the technique of the materials is the improvement of vacuum adhesion. It is preferred that an image-receiving sheet and a heat transfer sheet are retained on a drum by vacuum adhesion. Since an image is formed by the adhesion control of both sheets, image transfer behavior is very sensitive to the clearance between the image-receiving layer surface in an image-receiving sheet and the image-forming layer surface in a transfer sheet, hence vacuum adhesion is important. If the clearance between the materials is widened with foreign matter, e.g., dust, as a cue, image defect and image transfer unevenness come to occur.

For preventing such image defect and image transfer unevenness, it is preferred to give uniform unevenness to a heat transfer sheet to thereby improve the air passage, to obtain uniform clearance.

Technique 1 of the improvement of vacuum adhesion is the provision of unevenness to the surface of a heat transfer sheet. For obtaining sufficient effect of vacuum adhesion even in superposed printing of two or more colors, unevenness is provided to a heat transfer sheet. For providing unevenness to a heat transfer sheet, a method of post treatment such as embossing treatment and a method of addition of a matting agent to a coating layer are generally used, but in view of the simplification of manufacturing process and stabilization of materials with the lapse of time, addition of a matting agent is preferred. The particle size of a matting agent must be larger than the thickness of the coating layer. When a matting layer is added to an image-forming layer, there arises a problem of coming out of the image of the part where the matting layer is present, accordingly, it is preferred to add a matting agent having an optimal particle size, thereby the layer thickness of the image-forming layer becomes almost uniform and an image free of defect can be obtained on the image-receiving sheet.

The characteristics of the technique of systematization of the system of the present invention are described below. The first characteristics of the technique of systematization is the constitution of a recording unit. For surely reproducing sharp dots as described above, highly precise design is required also for a recording unit. The recording unit for use in the system of the present invention is the same as conventionally used recording units for laser heat transfer in fundamental constitution. The constitution is a so-called heat mode outer drum recording system and recording is performed such that a recording head provided with a plurality of high power lasers emit laser rays on a heat transfer sheet and an image-receiving sheet fixed on a drum. A preferred embodiment is as follows.

Constitution 1 of a recording unit is to prevent mixing of dust. Feeding of an image-receiving sheet and a heat transfer sheet is performed by full automatic roll feeding. Mixture of dusts generated from the human body cannot be helped by sheet feeding of a small number, thus roll feeding is adopted.

Since heat transfer sheet comprises four colors each one roll, a roll of each color is switched to another by a rotating loading unit. Each film is cut to a prescribed length by a cutter during loading and fixed on a drum. Constitution 2 of a recording unit is to enhance the adhesion of an image-receiving sheet and a heat transfer sheet on a recording drum. The adhesion of an image-receiving sheet and a heat transfer sheet on a recording drum is vacuum adhesion, since the adhesion of an image-receiving sheet and a heat transfer sheet cannot be strengthened by mechanical fixing. Many vacuum suction holes are formed on a recording drum, and a sheet is sucked by a drum by reducing the pressure in a drum with a blower or a decompression pump. Since a heat transfer sheet is further sucked over the sucked image-receiving sheet, the size of the heat transfer sheet is made larger than the size of the image-receiving sheet. The air between the heat transfer sheet and the image-receiving sheet which most affects recording performance is sucked from the area outside of the image-receiving sheet where the heat transfer sheet is alone.

Constitution 3 of a recording unit is accumulation of multi sheets of films on a discharge-receiving table stably. In the apparatus of the present invention, a multi sheets of large sized films of B2 size or larger can be accumulated on the discharge-receiving table. When sheet B is discharged on the image-receiving layer of the already accumulated heat-adhesive film A, sometimes both cleave to each other. When the previous sheet cleaves to the previous of the previous sheet, the next sheet cannot be discharged correctly, which leads to the problem of jamming. For preventing cleaving, the prevention of the contact of film A and film B is the best. Some means are known as the contact preventing method, e.g., (a) a method of making difference in discharge-receiving table level to make a gap between films by making film shape not plane, (b) a method of providing discharge port at higher position than discharge-receiving table and dropping a discharged film, and (c) a method of floating the film discharged later by blasting air between two films. In the system of the present invention, as the sheet size is very big (B2), the structures of units are large scaled when methods (a) and (b) are used, hence, (c) a method of floating the film discharged later by blasting air between two films is adopted.

Figure 2:
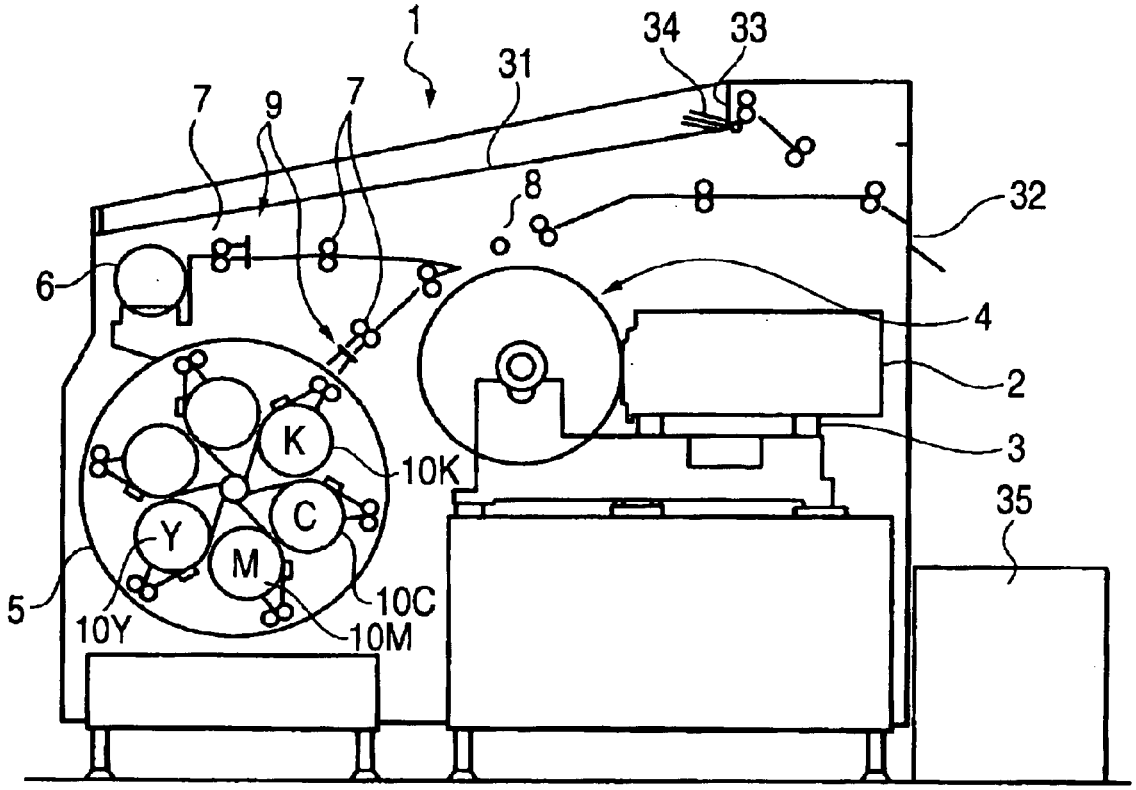
FIG. 2 is a drawing showing an example of constitution of a recording unit for laser heat transfer.

An example of constitution of the apparatus of the present invention is shown in FIG. 2.

The sequence of forming a full color image by applying an image-forming material to the apparatus of the present invention (hereinafter referred to as image-forming sequence of the system of the present invention) is described below.

1) Subsidiary scanning axis of recording head 2 of recording unit 1 is reset by subsidiary scanning rail 3, main scan rotation axis of recording drum 4 and heat transfer sheet loading unit 5 are respectively reset at origin.
2) Image-receiving sheet roll 6 is unrolled by carrier roller 7, and the tip of the image-receiving roll is fixed on recording drum 4 by vacuum suction (i.e., vacuum drawing) via suction holes provided on the recording drum.
3) Squeeze roller 8 comes down on recording drum 4 and presses the image-receiving sheet, and when the prescribed amount of the image-receiving sheet is conveyed by the rotation of the drum, the sheet is stopped and cut by cutter 9 in a prescribed length.
4) Recording drum 4 further makes a round, thus the loading of the image-receiving sheet is finished.
5) In the next place, in the same sequence as the image-receiving sheet, heat transfer sheet K of the first color, black, is drawn out from heat transfer sheet roll 10K, cut and loaded.
6) Recording drum 4 starts high speed rotation, recording head 2 on subsidiary scanning rail 3 starts to move and when reaches the start position of recording, recording laser is emitted on recording drum 4 by recording head 2 according to recording signals. Irradiation is finished at finishing position of recording, operation of subsidiary scanning rail and drum rotation are finished. The recording head on the subsidiary scanning rail is reset.

7) Only heat transfer sheet K is peeled with the image-receiving sheet remaining on the recording drum. For the peeling , the tip of heat transfer sheet K is caught by the claw, pulled out in the discharge direction, and discarded from discard port 32 to discard box 35.

8) The procedures of 5) to 7) are repeated for the remaining three colors. Recording is performed in the order of black, cyan, magenta and yellow. That is, heat transfer sheet C of the second color, cyan, is drawn out from heat transfer sheet roll 10C, heat transfer sheet M of the third color, magenta, is from heat transfer sheet roll 10M, and heat transfer sheet Y of the fourth color, yellow, is from heat transfer sheet roll 10Y in order. This is the inverse of general printing order, since the order of the colors on actual paper becomes inverse by the later process of transfer to actual paper.

9) After recording of four colors, the recorded image-receiving sheet is discharged to discharge-receiving table 31. The peeling method from the drum is the same as that of the heat transfer sheet in above 7), but since the image-receiving sheet is not discarded differently from the heat transfer sheets, the image-receiving sheet is returned to the discharge-receiving table by switch back when conveyed to discard port 32. When the image-receiving sheet is discharged to the discharge-receiving table, air 34 is blasted from under discharge port 33 to make it possible to accumulate a plurality of sheets.

It is preferred to use an adhesive roller provided with an adhesive material on the surface as carrier roller 7 of either feeding part or carrying part of the heat transfer sheet roll and the image-receiving sheet roll.

The surfaces of the heat transfer sheet and the image-receiving sheet can be cleaned by providing an adhesive roller.

As the adhesive materials provided on the surface of the adhesive roller, an ethylene-vinyl acetate copolymer, an ethylene-ethyl acrylate copolymer, a polyolefin resin, a polybutadiene resin, a styrene-butadiene copolymer (SBR), a styrene-ethylene-butene-styrene copolymer (SEBS), an acrylonitrile-butadiene copolymer (NBR), a polyisoprene resin (IR), a styrene-isoprene copolymer (SIS), an acrylic ester copolymer, a polyester resin, a polyurethane resin, an acrylate resin, a butyl rubber, and a polynorbornene can be exemplified.

An adhesive roller can clean the surfaces of the heat transfer sheet and the image-receiving sheet by being brought into contact with the surfaces of them, and the contact pressure is not particularly limited so long as they are in contact with the adhesive roller.

Vickers hardness Hv of the material having viscosity used in the adhesive roller is preferably 50 kg/mm$^2$ (=about 490 MPa) or less in view of capable of sufficiently removing foreign matters and suppressing image defect.

Vickers hardness is hardness obtained by measurement with applying static load to a pyramid indenter of diamond having the angle between the opposite faces of 136°, and Vickers hardness Hv can be obtained by the following equation:

$$\text{Hardness } Hv = 1.854\ P/d^2\ (\text{kg/mm}^2) = \text{about } 18.1692\ P/d^2\ (\text{Mpa})$$

wherein P: load (kg), d: the length of diagonal line of the square of depressed area (mm).

Also in the present invention, the modulus of elasticity at 20° C. of the material having viscosity used in the adhesive roller is preferably 200 kg/cm$^2$ (=about 19.6 MPa) or less in view of capable of sufficiently removing foreign matters and suppressing image defect similarly to the above.

The second characteristics of the technique of systematization is the constitution of the heat transfer unit.

The heat transfer unit is used for the steps of transferring the image-receiving sheet on which an image has been printed with a recording unit to an actual printing paper (hereinafter referred to as "actual paper"). This step is completely the same with First Proof™. When the image-receiving sheet and an actual paper are superposed and heat and pressure are applied thereto, both are adhered, and then the image-receiving film is peeled from the actual paper, an image and the adhesion layer remain on the actual paper, and the support of the image-receiving sheet and the cushioning layer are peeled off. Accordingly, it can be said that the image is transferred from the image-receiving sheet to the actual paper in practice.

Figure 3:
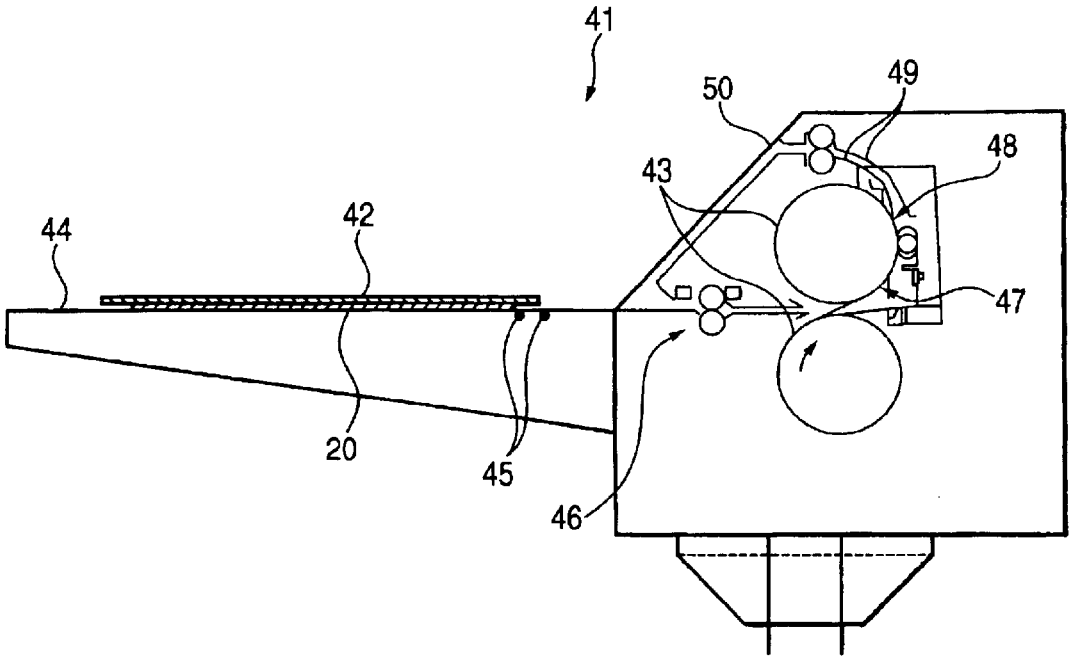
FIG. 3 is a drawing showing an example of constitution a heat transfer unit.

In First Proof™, transferring is performed by superposing an actual paper and an image-receiving sheet on an aluminum guide plate and passing them through a heat roller. The aluminum guide plate is for preventing the deformation of the actual paper. However, when an aluminum guide plate is adopted in the system of the present invention of B2 size, an aluminum guide plate larger than B2 size is necessary, which results in the problem that a large installation space is required. Accordingly, the system of the present invention does not use an aluminum guide plate and adopts the structure such that a carrier path rotates in a 180° arc and sheets are discharged on the side of insertion, thus the installation space can be largely saved (FIG. 3). However, there arises a problem of the deformation of an actual paper, since an aluminum guide plate is not used. Specifically, a pair of an actual paper and an image-receiving sheet curl with the image-receiving sheet inside and roll on the discharge-receiving table. It is very difficult work to peel the image-receiving sheet from the curled actual paper.

Therefore, curling prevention is tried by bimetallic effect by making use of the difference in shrinking amount between an actual paper and an image-receiving sheet and ironing effect of winding them around a hot roller. In the case where an image-receiving sheet is superposed on an actual paper and inserted as in conventional way, since the thermal shrinkage of an image-receiving sheet in the direction of insertion is larger than that of an actual paper, curling by bimetallic effect is such that the upper tends inward, which is the same direction as in the ironing effect and curling becomes serious by synergistic effect. Contrary to this, when an image-receiving sheet is superposed under an actual paper, curling by bimetallic effect tends downward and curling by ironing effect tends upward, thus curls are offset each other.

The sequence of an actual paper transfer is as follows (hereinafter referred to as the transfer method of an actual paper for use in the system of the present invention). Heat transfer unit 41 for use in this method as shown in FIG. 3 is a manual apparatus differently from a recording unit.

1) In the first place, the temperature of heat rollers 43 (from 100 to 110° C.) and the carrying velocity at transferring are set by dials (not shown) according to the kind of actual paper 42.

2) In the next place, image-receiving sheet 20 is put on an insert-receiving table with the image being upward, and the dust on the image is removed by an antistatic brush (not shown). Actual paper 42 from which dust has been removed is superposed thereon. At that time, since the size of actual paper 42 put upper side is larger than image-receiving sheet 20 put lower side, the position of image-receiving sheet 20 is not seen and alignment is difficult to do. For improving this work, marks showing the positions of placement of an image-receiving sheet and an actual paper 45 are marked on insert-receiving table 44. The reason the actual paper is larger than image-receiving sheet 20 is to prevent image-receiving sheet 20 from deviating and coming out from actual paper 42 and prevent the image-receiving layer of image-receiving sheet 20 from staining heat rollers 43.

3) The image-receiving sheet and the actual paper with being superposed are inserted into an insert port, and insert roller 46 rotates and feeds them to heat rollers 43.
4) When the tip of the actual paper comes to the position of heat rollers 43, the heat rollers nip them and transfer is started. The heat rollers are heat resisting silicone rubber rollers. Pressure and heat are applied simultaneously to the image-receiving sheet and the actual paper, thereby they are adhered. Guide 47 made of heat resisting sheet is installed on the down stream of the heat rollers, and a pair of the image-receiving sheet and the actual paper is carried upward through the upper heat roller and guide 47 with heating, they are peeled from the heat roller at peeling claw 48 and guided to discharge port 50 along guide plate 49.
5) A pair of the image-receiving sheet and the actual paper coming out of discharge port 50 is discharged on the insert-receiving table with being adhered. Thereafter, image-receiving sheet 20 is peeled from actual paper 42 manually.

The second characteristics of the technique of systematization is the constitution of the system.

By connecting the above units with a plate-making system, the function as color proof can be exhibited. As the system, it is necessary that a printed matter having an image quality approximating as far as possible to the printed matter outputted from certain plate-making data must be outputted from a proof. Therefore, a software for approximating dots and colors to the printed matter is necessary. The specific example of connection is described below.

When the proof of a printed matter is taken from the plate-making system Celebra™ (manufactured by Fuji Photo Film Co., Ltd.), the system connection is as follows. CTP (computer to plate) system is connected with Celebra. The final printed matter can be obtained by mounting the printing plate outputted from this system on a printing machine. As a color proof, the above recording unit Luxel FINALPROOF 5600 (manufactured by Fuji Photo Film Co., Ltd.) (hereinafter sometimes also referred to as "FINALPROOF") is connected with Celebra, and as proof drive software for approximating dots and colors to the printed matter, PD SYSTEM™ (manufactured by Fuji Photo Film Co., Ltd.) is also connected with Celebra.

Figure 4:
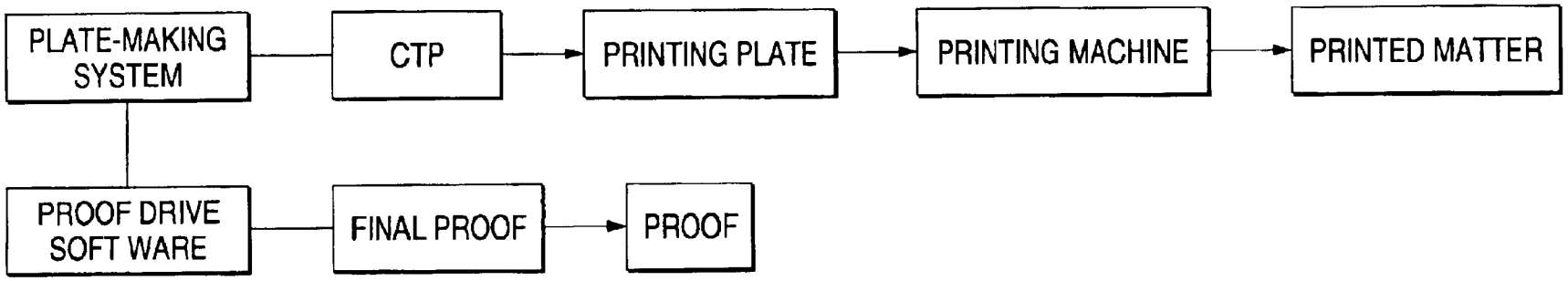
FIG. 4 is a drawing showing the scheme of a system using a recording unit FINALPROOF for laser heat transfer.

Contone data (continuous tone data) converted to raster data by Celebra are converted to binary data for dots and out putted to CTP system and finally printed. On the other hand, the same contone data are also outputted to PD system. PD system converts the received data according to four dimensional (black, cyan, magenta and yellow) table so that the colors coincide with the printed matter, and finally converts to binary data for dots so that the dots coincide with the dots of the printed matter and the data is outputted to FINALPROOF (FIG. 4).

The four dimensional table is experimentally prepared in advance and saved in the system. The experiment for the preparation of the four dimensional table is as follows. The printed image of important color data via CTP system and the outputted image of important color data from FINALPROOF via PD system are prepared, the measured color values of these images are compared and the table is formed so that the difference becomes minimum.

Thus, the present invention has realized the system constitution which can sufficiently exhibit the performance of the image-forming material having high definition.

The material of the heat transfer system for use in the system of the present invention is described below.

It is preferred that the absolute value of the difference between the surface roughness Rz of the front surface of the image-forming layer in the heat transfer sheet and the surface roughness Rz of the back surface of the image-forming layer is 3.0 or less, and absolute value of the difference between the surface roughness Rz of the front surface of the image-receiving layer in the image-receiving sheet and the surface roughness Rz of the back surface of the image-receiving layer is 3.0 or less. By such constitution of the present invention, conjointly with the above cleaning means, image defect can be prevented, jamming in carrying can be done away with, and dot gain stability can be improved.

The surface roughness Rz in the present invention means ten point average surface roughness corresponding to Rz (maximum height) defined in JIS B 0601. The surface roughness is obtained by inputting and computing the distance between the average value of the altitudes of from the highest peak to the fifth peak and the average value of the depths of from the deepest valley to the fifth valley. A feeler type three dimensional roughness meter (Surfcom 570A-3DF, manufactured by Tokyo Seimitsu Co., Ltd.) is used in measurement. The measurement is performed in machine direction, the cutoff value is 0.08 mm, the measured area is 0.6 mm×0.4 mm, the feed pitch is 0.005 mm, and the speed of measurement is 0.12 mm/sec.

For further improving the above-described effects, it is more preferred that the absolute value of the difference between the surface roughness Rz of the front surface of the image-forming layer in the heat transfer sheet and the surface roughness Rz of the back surface of the image-forming layer is 1.0 or less, and absolute value of the difference between the surface roughness Rz of the front surface of the image-receiving layer in the image-receiving sheet and the surface roughness Rz of the back surface of the image-receiving layer is 1.0 or less.

Further, as another embodiment, it is preferred that the surface roughness Rz of the front surface and the back surface of the heat transfer sheet and/or the surface roughness Rz of the front surface and the back surface of the image-receiving sheet is from 2 to 30 $\mu$m. By such constitution of the present invention, conjointly with the above cleaning means, image defect can be prevented, jamming in carrying can be done away with, and dot gain stability can be improved.

It is also preferred that the glossiness of the image-forming layer in the heat transfer sheet is from 80 to 99.

The glossiness largely depends upon the surface smoothness of the image-forming layer and can affect the uniformity of the layer thickness of the image-forming layer. When the glossiness is higher, the image-forming layer becomes more uniform and more preferred for highly minute use, but when the smoothness is high, the resistance at conveying becomes larger, thus they are in relationship of trade off. When the glossiness is from 80 to 99, both are compatible and well-balanced.

The scheme of multicolor image-forming by membrane heat transfer (i.e., thin film heat transfer) using a laser is described with referring to FIG. 1.

Laminate 30 for image formation comprising image-receiving sheet 20 laminated on the surface of image-forming layer 16 containing pigment black (K), cyan (C), magenta (M) or yellow (Y) in heat transfer sheet 10 is prepared. Heat transfer sheet 10 comprises support 12, having provided thereon light-to-heat converting layer 14 and further thereon image-forming layer 16, image-receiving sheet 20 comprises support 22 and having provided thereon image-receiving layer 24, and image-receiving layer 24 is laminated on the surface of image-forming layer 16 in heat transfer sheet 10 in contact therewith (FIG. 1(*a*)). When laser beams are emitted image-wise in time series from the side of support 12 in heat transfer sheet 10 of laminate 30, the irradiated area with laser beams of light-to-heat converting layer 14 in heat transfer sheet 10 generates heat, thereby the adhesion with image-forming layer 16 is reduced (FIG. 1(*b*)). Thereafter, when image-receiving sheet 20 and heat transfer sheet 10 are peeled off, the area irradiated with laser beams 16' of image-forming layer 16 is transferred to image-receiving layer 24 in image-receiving sheet 20 (FIG. 1(*c*)).

In multicolor image formation, the laser beam for use in irradiation preferably comprises multi-beams, particularly preferably comprises multi-beams of two-dimensional array. Multi-beams of two-dimensional array means, a plurality of laser beams are used when recording by irradiation with laser beam is performed, and the spot array of these laser beams comprises two-dimensional array comprised of a plurality of rows along the main scanning direction and a plurality of rows along the subsidiary scanning direction.

The time required in laser recording can be shortened by using multi-beams of two-dimensional array.

Any laser beam can be used in recording with no limitation, such as gas laser beams, e.g., an argon ion laser beam, a helium neon laser beam, and a helium cadmium laser beam, solid state laser beams, e.g., a YAG laser beam, and direct laser beams, e.g., a semiconductor laser beam, a dye laser beam and an eximer laser beam, can be used. Alternatively, laser beams obtained by converting these laser beams to half the wavelength through second harmonic generation elements can also be used. In multicolor image formation, semiconductor laser beams are preferably used taking the output power and easiness of modulation into consideration. In multicolor image formation, it is preferred that laser beam emission is performed on conditions that the beam diameter of laser beam on the light-to-heat converting layer is from 5 to 50 $\mu$m (in particular from 6 to 30 $\mu$m), and scanning speed is preferably 1 m/second or more (particularly preferably 3 m/second or more).

In addition, it is preferred in multicolor image formation that the layer thickness of the image-forming layer in the black heat transfer sheet is larger than the layer thickness of the image-forming layer in each of yellow, magenta and cyan heat transfer sheet, and is preferably from 0.5 to 0.7 $\mu$m. By adopting this constitution, the reduction of density due to transfer unevenness by the irradiation of the black heat transfer sheet with laser beams can be suppressed.

By restricting the layer thickness of the image-forming layer in the black heat transfer sheet to 0.5 $\mu$m or more, transfer unevenness is not generated by high energy recording and image density is maintained, thus required image density as the proof of printing can be attained. This tendency becomes more conspicuous under high humidity conditions, and so density variation due to circumferential conditions can be prevented. On the other hand, by making the layer thickness 0.7 $\mu$m or less, transfer sensitivity can be maintained at recording time by laser and touching of dots and fine lines can be improved. This tendency becomes more conspicuous under low humidity conditions. Definition can also be improved by the layer thickness of this range. The layer thickness of the image-forming layer in the black heat transfer sheet is more preferably from 0.55 to 0.65 $\mu$m and particularly preferably 0.60 $\mu$m.

Further, it is preferred that the layer thickness of the image-forming layer in the above black heat transfer sheet is from 0.5 to 0.7 $\mu$m, and the layer thickness of the image-forming layer in each of the above yellow, magenta and cyan heat transfer sheets is from 0.2 to less than 0.5 $\mu$m.

By making the layer thickness of each image-forming layer in yellow, magenta and cyan heat transfer sheets 0.2 $\mu$m or more, image density can be maintained without generating transfer unevenness when recording is performed by laser irradiation. On the other hand, by making the layer thickness less than 0.5 $\mu$m, transfer sensitivity and definition can be improved. The layer thickness of the image-forming layer in yellow, magenta and cyan heat transfer sheets is more preferably from 0.3 to 0.45 $\mu$m.

It is preferred for the image-forming layer in the black heat transfer sheet to contain carbon black, and the carbon black preferably comprises at least two carbon blacks having different tinting strength from the viewpoint of capable of controlling reflection density with maintaining P/B (pigment/binder) ratio in a specific range.

The tinting strength of carbon black can be represented variously, e.g., PVC blackness disclosed in JP-A-10-140033, can be exemplified. PVC blackness is the evaluation of blackness, i.e., carbon black is added to PVC resin, dispersed by a twin roll mill and made to a sheet, and the blackness of a sample is evaluated by visual judgement, with taking the blackness of Carbon Black #40 and #45 (manufactured by Mitsubishi Chemicals Co., Ltd.) as 1 point and 10 points respectively as the standard values. Two or more carbon black shaving different PVC blackness can be used arbitrarily according to purposes.

The specific producing method of a sample is described below.

Producing Method of Sample

In a banbury mixer having a capacity of 250 ml, 40 mass % (i.e., weight %) of sample carbon black was compounded to LDPE (low density polyethylene) resin and kneaded at 115° C. for 4 minutes.

| Compounding condition | |
|---|---|
| LDPE resin | 101.89 g |
| Calcium stearate | 1.39 g |
| Irganox ® 1010 | 0.87 g |
| Sample carbon black | 69.43 g |

In the next place, dilution was performed in a twin roll mill at 120° C. so as to reach the concentration of carbon black of 1 mass %.

| Preparation condition of diluted compound | |
|---|---|
| LDPE resin | 58.3 g |
| Calcium stearate | 0.2 g |
| Resin compounded with 40 mass % of carbon black | 1.5 g |

The above-prepared product was made to s sheet having a slit width of 0.3 mm, the sheet was cut to chips, and a film having a thickness of 65±3 μm was formed on a hot plate at 240° C.

A multicolor image may be formed, as described above, by the method of using the heat transfer sheet, and repeatedly superposing many image layers (an image-forming layer on which an image is formed) on the same image-receiving sheet, alternatively a multicolor image may be formed by the method of forming images on a plurality of image-receiving sheet once, and then transferring these images to actual paper.

With the latter case, for example, heat transfer sheets each having image-forming layer containing coloring material mutually different in hue are prepared, and independently four kinds (cyan, magenta, yellow, black) of laminates for image-forming comprising the above heat transfer sheet combined with an image-receiving sheet are produced. Laser emission according to digital signals on the basis of the image is performed to each laminate through a color separation filter, subsequently the heat transfer sheet and the image-receiving sheet are peeled off, to thereby form independently a color separated image of each color on each image-receiving sheet. Thereafter, the thus-formed each color separated image is laminated in sequence on an actual support, such as actual printing paper prepared separately, or on a support approximates thereto, thus a multicolor image can be formed.

It is preferred for the heat transfer sheet utilizing laser irradiation to form an image by the system of converting laser beams to heat and membrane transferring the image-forming layer containing a pigment on the image-receiving sheet using the above converted heat energy. However, these techniques used for the development of the image-forming material comprising the heat transfer sheet and the image-receiving sheet can be arbitrarily applied to the development of the heat transfer sheets of a heat fusion transfer system, an ablation transfer system, and sublimation system and/or the development of an image-receiving sheet, and the system of the present invention may include image-forming materials used in these systems.

A heat transfer sheet and an image-receiving sheet are described below in detail.

Heat Transfer Sheet

A heat transfer sheet comprises a support having thereon at least a light-to-heat converting layer and an image-receiving layer, and, if necessary, other layers.

Support

The materials of the support of the heat transfer sheet are not particularly restricted, and various supports can be used according to purposes. The support preferably has stiffness, good dimensional stability, and heat resistance capable of resisting the heat at image formation. The preferred examples of the support include synthetic resins, e.g., polyethylene terephthalate, polyethylene-2,6-naphthalate, polycarbonate, polymethyl methacrylate, polyethylene, polypropylene, polyvinyl chloride, polyvinylidene chloride, polystyrene, styrene-acrylonitrile copolymer, polyamide (aromatic and aliphatic), polyimide, polyamideimide, and polysulfone. Biaxially stretched polyethylene terephthalate is preferred above all from the viewpoint of mechanical strength and dimensional stability against heat. When resins are used in the preparation of color proofs utilizing laser recording, it is preferred to form the support of a heat transfer sheet from transparent synthetic resins which transmit laser beams. The thickness of the support is preferably from 25 to 130 μm, particularly preferably from 50 to 120 μm. The central line average surface roughness Ra of the support of the side on which an image-forming layer is provided is preferably less than 0.1 μm (the value obtained by measurement using Surfcom, manufactured by Tokyo Seiki Co., Ltd., according to JIS B0601). The Young's modulus of the support in the machine direction is preferably from 200 to 1,200 kg/mm$^2$ (=about 2 to 12 GPa), and the Young's modulus of the support in the transverse direction is preferably from 250 to 1,600 kg/mm$^2$ (=about 2.5 to 16 GPa). The F-5 value of the support in the machine direction is preferably from 5 to 50 kg/mm$^2$ (=about 49 to 490 MPa), and the F-5 value of the support in the transverse direction is preferably from 3 to 30 kg/mm$^2$ (=about 29.4 to 294 MPa), and the F-5 value of the support in the machine direction is generally higher than the F-5 value of the support in the transverse direction, but when it is necessary to make the strength particularly in the transverse direction high, this rule does not apply to the case. Further, the heat shrinkage at 100° C. for 30 minutes of the support in the machine direction is preferably 3% or less, more preferably 1.5% or less, the heat shrinkage at 80° C. for 30 minutes is preferably 1% or less, more preferably 0.5% or less. The breaking strength is from 5 to 100 kg/mm$^2$ (=about 49 to 980 MPa) in both directions, and the modulus of elasticity is preferably from 100 to 2,000 kg/mm$^2$ (=about 0.98 to 19.6 GPa).

The support of the heat transfer sheet may be subjected to surface activation treatment and/or one or two or more undercoat layers may be provided on the support for the purpose of improving the adhesion with the light-to-heat converting layer which is provided on the support. As the examples of the surface activation treatments, glow discharge treatment and corona discharge treatment can be exemplified. As the materials of the undercoat layer, materials having high adhering property to both surfaces of the support and the light-to-heat converting layer, low heat conductivity, and excellent heat resisting property are preferably used. As the materials of such an undercoat layer, styrene, a styrene-butadiene copolymer and gelatin can be exemplified. The thickness of the undercoat layer is generally from 0.01 to 2 μm as a whole. If necessary, various functional layers such as a reflection-preventing layer and an antistatic layer may be provided on the surface of the heat transfer sheet of the side opposite to the side on which a light-to-heat converting layer is provided, or the support may be subjected to various surface treatments.

Backing Layer

It is preferred to provide a backing layer on the surface of the heat transfer sheet of the side opposite to the side on which a light-to-heat converting layer is provided. The backing layer preferably comprises the first backing layer contiguous to the support and the second backing layer provided on the side of the support opposite to the side on which the first backing layer is provided. In the present invention, the mass (i.e., the weight) A of the antistatic agent contained in the first backing layer to the mass (i.e., the weight) the B of the antistatic agent contained in the second backing layer, B/A is preferably less than 0.3. When B/A is 0.3 or more, a sliding property and powder dropout resistance of the backing layer are liable to be deteriorated.

The layer thickness C of the first backing layer is preferably from 0.01 to 1 μm, more preferably from 0.01 to 0.2 μm. The layer thickness D of the second backing layer is preferably from 0.01 to 1 μm, more preferably from 0.01 to 0.2 μm. The ratio of the layer thickness of the first backing layer to that of the second backing layer, C/D is preferably from 1/2 to 5/1.

As the antistatic agents for use in the first and second backing layers, a nonionic surfactant, e.g., polyoxyethylene alkylamine, and glycerol fatty acidester; a cationic surfactant, e.g., quaternary ammonium salt; an anionic surfactant, e.g., alkylphosphate; an ampholytic surfactant and electrically conductive resin can be exemplified.

Electrically conductive fine particles can also be used as antistatic agents. The examples of such electrically conductive fine particles include oxides, e.g., ZnO, $TiO_2$, $SnO_2$, $Al_2O_3$, $In_2O_3$, MgO, BaO, CoO, CuO, $Cu_2O$, CaO, SrO, $BaO_2$, PbO, $PbO_2$, $MnO_3$, $MoO_3$, $SiO_2$, $ZrO_2$, $Ag_2O$, $Y_2O_3$, $Bi_2O_3$, $Ti_2O_3$, $Sb_2O_3$, $Sb_2O_5$, $K_2Ti_6O_3$, $NaCaP_2O_{18}$ and $MgB_2O_5$; sulfide, e.g., CuS and ZnS; carbide, e.g., SiC, TiC, ZrC, VC, NbC, MoC and WC; nitride, e.g., $Si_3N_4$, TiN, ZrN, VN, NbN and $Cr_2N$; boride, e.g., $TiB_2$, $ZrB_2$, $NbB_2$, $TaB_2$, CrB, MoB, WB and $LaB_5$; silicide, e.g., $TiSi_2$, $ZrSi_2$, $NbSi_2$, $TaSi_2$, $CrSi_2$, $MoSi_2$ and $WSi_2$; metal salts, e.g., $BaCO_3$, $CaCO_3$, $SrCO_3$, $BaSO_4$and $CaSO_4$; and composite, e.g., $SiN_4$—SiC and $9Al_2O_3$-$2B_2O_3$. These electrically conductive fine particles may be used alone or in combination of two or more. Of these fine particles, $SnO_2$, ZnO, $Al_2O_3$, $TiO_2$, $In_2O_3$, MgO, BaO and $MoO_3$ are preferred, $SnO_2$, ZnO, $In_2O_3$ and $TiO_2$ are more preferred, and $SnO_2$ is particularly preferred.

When the heat transfer sheet of the present invention is used in a laser heat transfer system, the antistatic agent used in the backing layer is preferably substantially transparent so that laser beams can be transmitted.

When electrically conductive metallic oxides are used as the antistatic agent, their particle size is preferably smaller to make light scattering as small as possible, but the particle size should be determined using the ratio of the refractive indices of the particles and the binder as parameter, which can be obtained according to the theory of Mie. The average particle size of the electrically conductive metallic oxides is generally from 0.001 to 0.5 μm, preferably from 0.003 to 0.2 μm. The average particle size used herein is the value of the particle size of not only the primary particles of the electrically conductive metallic oxides but the particle size of the particles having the (hkl) structure is included.

Besides an antistatic agent, the first and second backing layers may contain various additives, such as a surfactant, a sliding agent and a matting agent, and a binder. The amount of the antistatic agent contained in the first backing layer is preferably from 10 to 1,000 mass parts (i.e., weight parts) per 100 mass parts (i.e., weight parts) of the binder, more preferably from 200 to 800 mass parts. The amount of the antistatic agent contained in the second backing layer is preferably from 0 to 300 mass parts per 100 mass parts of the binder, more preferably from 0 to 100 mass parts.

As the binders for use for forming the first and second backing layers, homopolymers and copolymers of acrylic acid-based monomers, e.g., acrylic acid, methacrylic acid, acrylic ester and methacrylic ester, cellulose-based polymers, e.g., nitrocellulose, methyl cellulose, ethyl cellulose and cellulose acetate, vinyl-based polymers and copolymers of vinyl compounds, e.g., polyethylene, polypropylene, polystyrene, vinyl chloride-based copolymer, vinyl chloride-vinyl acetate copolymer, polyvinyl pyrrolidone, polyvinyl butyral and polyvinyl alcohol, condensed polymers, e.g., polyester, polyurethane and polyamide, rubber-based thermoplastic polymers, e.g., butadiene-styrene copolymer, polymers obtained by polymerization or crosslinking of photopolymerizable or heat polymerizable compounds, e.g., epoxy compounds, and melamine compounds can be exemplified.

Light-to-Heat Converting Layer

The light-to-heat converting layer may contain a light-to-heat converting material, a binder, and other additives, if necessary.

Alight-to-heat converting material is a material having a function of converting irradiated light energy to heat energy. A light-to-heat converting material is in general a dye (inclusive of a pigment, hereinafter the same) capable of absorbing a laser beam. When image-recording is performed by infrared laser irradiation, it is preferred to use an infrared absorbing dye as the light-to-heat converting material. As the examples of the dyes, black pigments, e.g., carbon black, pigments of macrocyclic compounds having absorption in the visible region to the near infrared region, e.g., phthalocyanine and naphthalocyanine, organic dyes which are used as the laser-absorbing material in high density laser recording such as a magneto-optical disc, e.g., a cyanine dye such as an indolenine dye, an anthraquinone dye, an azulene dye and a phthalocyanine dye, and organic metallic compound dyes, e.g., dithiol nickel complex, can be exemplified. Of the above compounds, cyanine dyes are particularly preferably used, since they show a high absorption coefficient to the lights in the infrared region, and the thickness of a light-to-heat converting layer can be thinned when used as the light-to-heat converting material, as a result, the recording sensitivity of a heat transfer sheet can be further improved.

As the light-to-heat converting material, particulate metallic materials such as blackened silver and inorganic materials can also be used besides dyes.

As the binder to be contained in the light-to-heat converting layer, resins having at least the strength capable of forming a layer on a support and preferably having high heat conductivity. Heat resisting resins which are not decomposed by heat generated from the light-to-heat converting material at image recording are preferably used as the binder resin, since the surface smoothness of the light-to-heat converting layer can be maintained after irradiation even when light irradiation is performed with high energy. Specifically, resins having heat decomposition temperature (temperature at which the mass (i.e., the weight) decreases by 5% in air current at temperature increasing velocity of 10° C./min by TGA method (thermal mass spectrometry)) of 400° C. or more are preferably used, more preferably 500° C. or more. Binders preferably have glass transition temperature of from 200 to 400° C., more preferably from 250 to 350° C. When the glass transition temperature is lower than 200° C., there is a case where fog is generated on the image to be formed, while when it is higher than 400° C., the solubility of the resin is decreased, followed by the reduction of the productivity in some cases.

Further, the heat resistance (e.g., heat deformation temperature and heat decomposition temperature) of the binder in the light-to-heat converting layer is preferably higher than the heat resistance of the materials used in other layers provided on the light-to-heat converting layer.

Specifically, acrylate resins, e.g., polymethyl methacrylate, vinyl resins, e.g., polycarbonate, polystyrene, vinyl chloride/vinyl acetate copolymer and polyvinyl alcohol, polyvinyl butyral, polyester, polyvinyl chloride, polyamide, polyimide, polyether imide, polysulfone, polyether sulfone, aramid, polyurethane, epoxy resin and urea/ melamine resin are exemplified as the binder resins for use in the light-to-heat converting layer. Of these resins, polyimide resin is preferred.

Polyimide resins represented by the following formulae (I) to (VII) are soluble in an organic solvent and the productivity of the heat transfer sheet is improved when they are used. Further, these polymide resins are preferred in view of capable of improving the stability of viscosity, long term storage stability and moisture resistance of the coating solution for the light-to-heat converting layer.

(I)

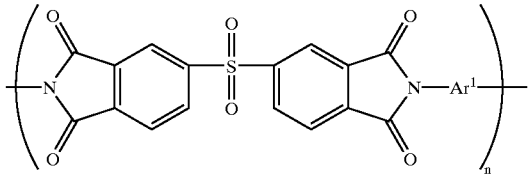

(II)

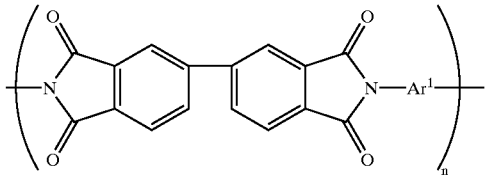

In formulae (I) and (II), $Ar^1$ represents an aromatic group represented by the following formula (1), (2) or (3), and n represents an integer of from 10 to 100.

(1)

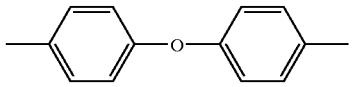

(4)

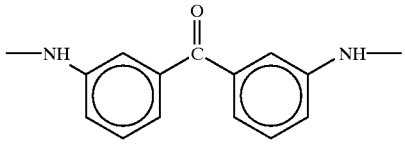

(6)

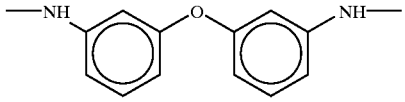

-continued (2)

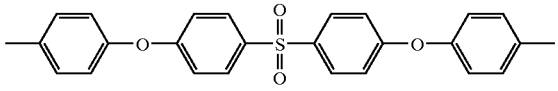

(3)

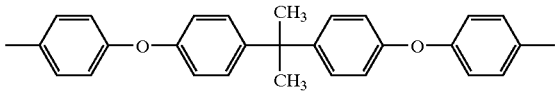

(III)

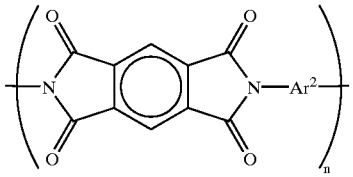

(IV)

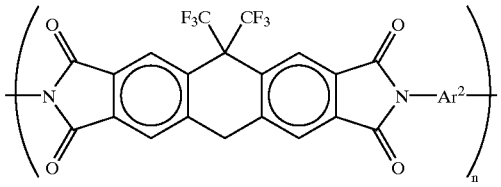

In formulae (III) and (IV), $Ar^2$ represents an aromatic group represented by the following formula (4), (5), (6) or (7), and n represents an integer of from 10 to 100.

(5)

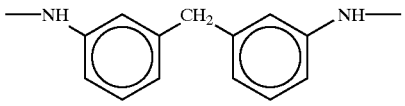

(7)

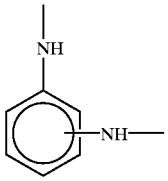

(V)

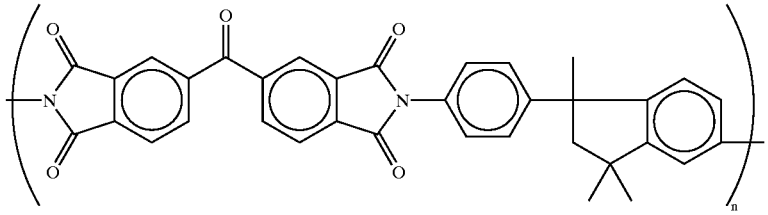

-continued (VI)

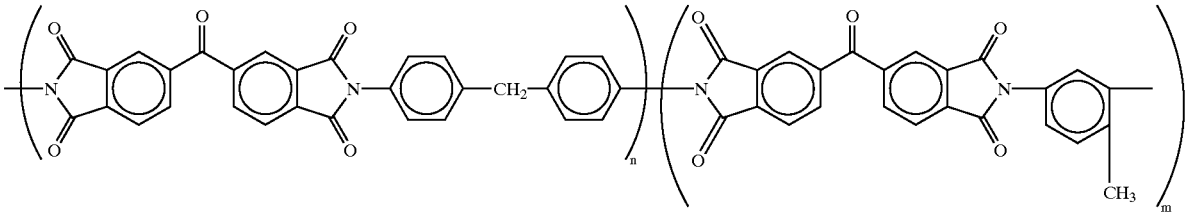

(VII)

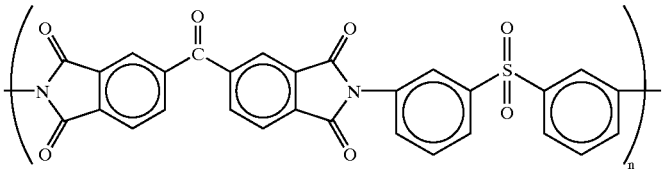

In formulae (V), (VI) and (VII), n and m each represents an integer of from 10 to 100. In formula (VI), the ratio of n/m is from 6/4 to 9/1.

As the criterion whether a resin is soluble in an organic solvent or not, when 10 mass parts (i.e., weight parts) or more of the resin is dissolved in 100 mass parts of N-methylpyrrolidone at 25° C., the resin can be preferably used in the light-to-heat converting layer, more preferably 100 mass parts is dissolved in 100 mass parts of N-methylpyrrolidone.

The light-to-heat converting layer may contain a surfactant, a thickener, and an antistatic agent, if necessary.

The light-to-heat converting layer can be provided by dissolving a light-to-heat converting material and a binder, adding, if necessary, a matting agent and other components thereto to thereby prepare a coating solution, coating the coating solution on a support and drying. As the organic solvents for dissolving polyimide resins, e.g., n-hexane, cyclohexane, diglyme, xylene, toluene, ethyl acetate, tetrahydrofuran, methyl ethyl ketone, acetone, cyclohexanone, 1,4-dioxane, 1,3-dioxane, dimethyl acetate, N-methyl-2-pyrrolidone, dimethyl sulfoxide, dimethylformamide, dimethylacetamide, y-butyrolactone, ethanol and methanol can be exemplified. Coating and drying can be performed according to ordinary coating and drying methods. Drying is generally performed at 300° C. or less, preferably 200° C. or less. When polyethylene terephthalate is used as the support, the drying temperature is preferably from 80 to 150° C.

If the amount of the binder in the light-to-heat converting layer is not sufficient, the cohesive strength of the light-to-heat converting layer lowers and the light-to-heat converting layer is liable to be transferred together when an image formed is transferred to an image-receiving sheet, which causes color mixing. While when the amount of the polyimide resin is too much, the layer thickness of the light-to-heat converting layer becomes too large to achieve a definite absorptivity, thereby sensitivity is liable to be decreased. The mass ratio (i.e., the weight ratio) of the solid content of the light-to-heat converting material to the binder in the light-to-heat converting layer is preferably 1/20 to 2/1, particularly preferably 1/10 to 2/1.

As described above, when the layer thickness of the light-to-heat converting layer is thinned, the sensitivity of the heat transfer sheet is increased and so preferred. The layer thickness of the light-to-heat converting layer is preferably from 0.03 to 1.0 μm, more preferably from 0.05 to 0.5 μm. Further, when the light-to-heat converting layer has the optical density of from 0.80 to 1.26 to the peak wavelength of laser beam, e.g., a beam having wavelength of 808 nm, the transfer sensitivity of the image-forming layer is improved, more preferably the light-to-heat converting layer has the optical density of from 0.92 to 1.15. When the optical density at peak wavelength of laser beam is less than 0.80, irradiated light cannot be sufficiently converted to heat and sometimes transfer sensitivity is reduced. Contrary to this, when it exceeds 1.26, the function of the light-to-heat converting layer is affected and sometimes fog is generated. In the present invention, the optical density of the light-to-heat converting layer in the heat transfer sheet means the absorbance of the light-to-heat converting layer at peak wavelength of the laser beams to be used when the image-forming material of the present invention is subjected to recording, and the optical density can be measured with well-known spectrophotometers. UV-spectrophotometer UV-240 (manufactured by Shimadzu Seisakusho Co. Ltd.) was used in the present invention. The value obtained by subtracting the optical density of the support alone from the optical density including the support is taken as the above optical density.

Image-Forming Layer

An image-forming layer contains at least a pigment which is transferred to an image-receiving sheet and forms an image, in addition, a binder for forming the layer and, if necessary, other components.

Pigments are broadly classified to organic pigments and inorganic pigments, and they have respectively characteristics such that the former are particularly excellent in the transparency of the film, and the latter are excellent in shielding property, thus they may be used arbitrarily according to purposes. When the heat transfer sheet is used for the proofs of printing colors, organic pigments which are coincident with yellow, magenta, cyan and black generally used in printing ink or near to them in hue are preferably used. Further, metallic powder and fluorescent pigments are also used in some cases. The examples of the pigments which are preferably used include azo pigments, phthalocyanine pigments, anthraquinone pigments, dioxazine pigments, quinacridone pigments, isoindolinone pigments and nitro pigments. The pigments for use in an image-forming layer are listed below by colors, but the present invention is not limited thereto.

1) Yellow pigment

Pigment Yellow 12 (C.I. No. 21090)

EXAMPLE

Permanent Yellow DHG (manufactured by Clariant Japan, K.K.), Lionol Yellow 1212B (manufactured by Toyo Ink Mfg. Co., Ltd.), Irgalite Yellow LCT (manufactured by Ciba Specialty Chemicals), Symuler Fast Yellow GTF 219 (manufactured by Dai-Nippon Ink & Chemicals, Inc.)

Pigment Yellow 13 (C.I. No. 21100)

EXAMPLE

Permanent Yellow GR (manufactured by Clariant Japan, K.K.), Lionol Yellow 1313 (manufactured by Toyo Ink Mfg. Co., Ltd.)

Pigment Yellow 14 (C.I. No. 21095)

EXAMPLE

Permanent Yellow G (manufactured by Clariant Japan, K.K.), Lionol Yellow 1401-G (manufactured by Toyo Ink Mfg. Co., Ltd.), Seika Fast Yellow 2270 (manufactured by Dainichi Seika K. K.), Symuler Fast Yellow 4400 (manufactured by Dai-Nippon Ink & Chemicals, Inc.)

Pigment Yellow 17 (C.I. No. 21105)

EXAMPLE

Permanent Yellow GG02 (manufactured by Clariant Japan, K.K.), Symuler Fast Yellow 8GF (manufactured by Dai-Nippon Ink & Chemicals, Inc.)

Pigment Yellow 155

EXAMPLE

Graphtol Yellow 3GP (manufactured by Clariant Japan, K.K.) Pigment Yellow 180 (C.I. No. 21290)

EXAMPLE

Novoperm Yellow P-HG (manufactured by Clariant Japan, K.K.), PV Fast Yellow HG (manufactured by Clariant Japan, K.K.)

Pigment Yellow 139 (C.I. No. 56298)

EXAMPLE

Novoperm Yellow M2R 70 (manufactured by Clariant Japan, K.K.)

2) Magenta Pigment

Pigment Red 57:1 (C.I. No. 15850:1)

EXAMPLE

Graphtol Rubine L6B (manufactured by Clariant Japan, K.K.), Lionol Red 6B-4290G (manufactured by Toyo Ink Mfg. Co., Ltd.), Irgalite Rubine 4BL (manufactured by Ciba Specialty Chemicals), Symuler Brilliant Carmine 6B-229 (manufactured by Dai-Nippon Ink & Chemicals, Inc.)

Pigment Red 122 (C.I. No. 73915)

EXAMPLE

Hosterperm Pink E (manufactured by Clariant Japan, K.K.), Lionogen Magenta 5790 (manufactured by Toyo Ink Mfg. Co., Ltd.),Fastogen Super Magenta RH (manufactured by Dai-Nippon Ink & Chemicals, Inc.)

Pigment Red 53:1 (C.I. No. 15585:1)

EXAMPLE

Permanent Lake Red LCY (manufactured by Clariant Japan, K. K.), Symuler Lake Red C conc (manufactured by Dai -Nippon Ink & Chemicals, Inc.)

Pigment Red 48:1 (C.I. No. 15865:1)

EXAMPLE

Lionol Red 2B-3300 (manufactured by Toyo Ink Mfg. Co., Ltd.), Symuler Red NRY (manufactured by Dai-Nippon Ink & Chemicals, Inc.)

Pigment Red 48:2 (C.I. No. 15865:2)

EXAMPLE

Permanent Red W2T (manufactured by Clariant Japan, K.K.), Lionol Red LX235 (manufactured by Toyo Ink Mfg. Co., Ltd.), Symuler Red3012 (manufactured by Dai-NipponInk & Chemicals, Inc.)

Pigment Red 48:3 (C.I. No. 15865:3)

EXAMPLE

Permanent Red 3RL (manufactured by Clariant Japan, K.K.), Symuler Red 2BS (manufactured by Dai-Nippon Ink & Chemicals, Inc.)

Pigment Red 177 (C.I. No. 65300)

EXAMPLE

Cromophtal Red A2B (manufactured by Ciba Specialty Chemicals)

3) Cyan Pigment

Pigment Blue 15 (C.I. No. 74160)

EXAMPLE

Lionol Blue 7027 (manufactured by Toyo Ink Mfg. Co., Ltd.), Fastogen Blue BB (manufactured by Dai-Nippon Ink & Chemicals, Inc.)

Pigment Blue 15:1 (C.I. No. 74160)

EXAMPLE

Hosterperm Blue A2R (manufactured by Clariant Japan, K.K.), Fastogen Blue 5050 (manufactured by Dai-Nippon Ink & Chemicals, Inc.)

Pigment Blue 15:2 (C.I. No. 74160)

EXAMPLE

Hosterperm Blue AFL (manufactured by Clariant Japan, K.K.), Irgalite Blue BSP (manufactured by Ciba Specialty Chemicals), Fastogen Blue GP (manufactured by Dai-NipponInk & Chemicals, Inc.)

Pigment Blue 15:3 (C.I. No. 74160)

EXAMPLE

Hosterperm Blue B2G (manufactured by Clariant Japan, K.K.), Lionol Blue FG7330 (manufactured by Toyo Ink Mfg. Co., Ltd.), Cromophtal Blue 4GNP (manufactured by Ciba Specialty Chemicals), Fastogen Blue FGF (manufactured by Dai-Nippon Ink & Chemicals, Inc.)

Pigment Blue 15:4 (C.I. No. 74160)

EXAMPLE

Hosterperm Blue BFL (manufactured by Clariant Japan, K.K.), Cyanine Blue 700-1OFG (manufactured by Toyo Ink Mfg. Co., Ltd.), Irgalite Blue GLNF (manufactured by Ciba Specialty Chemicals), Fastogen Blue FGS (manufactured by Dai-Nippon Ink & Chemicals, Inc.)

Pigment Blue 15:6 (C.I. No. 74160)

EXAMPLE

Lionol Blue ES (manufactured by Toyo Ink Mfg. Co., Ltd.)

Pigment Blue 60 (C.I. No. 69800)

EXAMPLE

Hosterperm Blue RL01 (manufactured by Clariant Japan, K.K.), Lionogen Blue 6501 (manufactured by Toyo Ink Mfg. Co., Ltd.)

4) Black Pigment

Pigment Black 7 (carbon black C.I. No. 77266)

EXAMPLE

Mitsubishi Carbon Black MA100 (manufactured by Mitsubishi Chemicals Co., Ltd.), Mitsubishi Carbon Black #5 (manufactured by Mitsubishi Chemicals Co., Ltd.), Black Pearls 430 (manufactured by Cabot Co.)

As the pigments which can be used in the present invention, commercially available products can be arbitrarily selected by referring to *Ganryo Binran* (*Pigment Handbook*), compiled by Nippon Ganryo Gijutsu Kyokai, published by Seibundo-Shinko-Sha (1989), and *COLOUR INDEX, THE SOCIETY OF DYES & COLOURIST*, Third Ed. (1987).

The average particle size of the above pigments is preferably from 0.03 to 1 μm, more preferably from 0.05 to 0.5 μm.

When the particle size is 0.03 μm or more, the costs for dispersion are not increased and the dispersion solution does not cause gelation, while when it is 1 μm or less, since coarse particles are not contained in pigments, good adhesion of the image-forming layer and the image-receiving layer can be obtained, further, the transparency of the image-forming layer can also be improved.

As the binders for the image-forming layer, amorphous organic high polymers having a softening point of from 40 to 150° C. are preferably used. As the amorphous organic high polymers, homopolymers and copolymers of styrene, derivatives thereof, and substitution products thereof, e.g., butyral resin, polyamide resin, polyethyleneimine resin, sulfonamide resin, polyester polyol resin, petroleum resin, styrene, vinyltoluene, a-methylstyrene, 2-methylstyrene, chlorostyrene, vinylbenzoic acid, sodium vinylbenzenesulfonate, and aminostyrene, methacrylic esters and methacrylic acid, e.g., methyl methacrylate, ethyl methacrylate, butyl methacrylate, and hydroxyethyl methacrylate, acrylic esters and acrylic acid, e.g., methyl acrylate, ethyl acrylate, butyl acrylate, and a-ethylhexyl acrylate, dienes, e.g., butadiene and isoprene, homopolymers of vinyl monomers or copolymers of vinyl monomers with other monomers, e.g., acrylonitrile, vinyl ethers, maleic acid and maleic esters, maleic anhydride, cinnamic acid, vinyl chloride and vinyl acetate can be used. Two or more of these resins may be used as mixture.

It is preferred for the image-forming layer to contain a pigment in an amount of from 30 to 70 mass % (i.e., weight %), more preferably from 30 to 50 mass %. It is also preferred for the image-forming layer to contain a resin in an amount of from 30 to 70 mass %, more preferably from 40 to 70 mass %.

The image-forming layer can contain the following components (1) to (3) as the above-described other components.

(1) Waxes

The examples of waxes include mineral waxes, natural waxes and synthetic waxes. As the examples of the mineral waxes, paraffin wax, microcrystalline wax, ester wax, petroleum wax such as oxide wax, montan wax, ozokerite and ceresin can be exemplified. Paraffin wax is preferred above all. The paraffin wax is separated from petroleum, and various products are commercially available according to melting points.

As the examples of the natural waxes, vegetable wax, e.g., carnauba wax, Japan wax, Quriculy wax and esparto wax, animal wax, e.g., beeswax, insect wax, shellac wax and spermaceti can be exemplified.

The synthetic waxes are generally used as a lubricant and generally comprises higher fatty acid compounds. As the examples of the synthetic waxes, the following can be exemplified.

1) Fatty Acid-Based Wax

A straight chain saturated fatty acid represented by the following formula:

$$CH_3\ (CH_2)_nCOOH$$

In the formula, n represents an integer of from 6 to 28. As the specific examples, stearic acid, behenic acid, palmitic acid, 12-hydroxystearic acid, and azelaic acid can be exemplified.

In addition, the metal salts of the above fatty acids (e.g., with K, Ca, Zn and Mg) can be exemplified.

2) Fatty Acid Ester-Based Wax

As the examples of the fatty acid esters, ethyl stearate, lauryl stearate, ethyl behenate, hexyl behenate and behenyl myristate can be exemplified.

3) Fatty Acid Amide-Based Wax

As the examples of the fatty acid amides, stearic acid amide and lauric acid amide can be exemplified.

4) Aliphatic Alcohol-Based Wax

A straight chain saturated aliphatic alcohol represented by the following formula:

$$CH_3\ (CH_2)_nOH$$

In the formula, n represents an integer of from 6 to 28. As the specific examples, stearyl alcohol can be exemplified.

Of the above synthetic waxes 1) to 4), higher fatty acid amides such as stearic acid amide and lauric acid amide are preferred. Further, these wax compounds can be used alone or in arbitrary combination, as desired.

(2) Plasticizers

As the plasticizers, ester compounds are preferred, and well-known plasticizers can be exemplified, such as phthalic acid esters, e.g., dibutyl phthalate, di-n-octyl phthalate, di(2-ethylhexyl) phthalate, dinonyl phthalate, dilauryl phthalate, butyllauryl phthalate, and butylbenzyl phthalate, aliphatic dibasic acid esters, e.g., di (2-ethylhexyl) adipate, and di(2-ethylhexyl) sebacate, phosphoric triesters, e.g., tricresyl phosphate and tri(2-ethylhexyl) phosphate, polyol polyesters, e.g., polyethylene glycol ester, and epoxy compounds, e.g.,epoxy fatty acidester. Of these,esters of vinyl monomers, in particular, acrylic esters and methacrylic esters are preferred in view of the improvement of transfer sensitivity, the improvement of transfer unevenness, and the big controlling effect of breaking elongation.

As the acrylic or methacrylic ester compounds, polyethylene glycol dimethacrylate, 1,2,4-butanetriol trimethacrylate, trimethylolethane triacrylate, pentaerythritol acrylate, pentaerythritol tetraacrylate, dipentaerythritol polyacrylate can be exemplified.

The above plasticizers may be high polymers, and polyesters are preferred above all, since the addition effect is large and they hardly diffuse under storage conditions. As the polyesters, e.g., sebacic acid polyester and adipic acid polyester are exemplified.

The additives contained in the image-forming layer are not limited thereto. The plasticizers may be used alone or in combination of two or more.

When the addition amount of these additives in the image-forming layer are too much, in some cases, the definition of the transferred image is deteriorated, the film strength of the image-forming layer itself is reduced, or the unexposed area is transferred to the image-receiving sheet due to the reduction of the adhesion of the light-to-heat converting layer and the image-forming layer. From the above viewpoint, the content of the waxes is preferably from 0.1 to 30 mass % (i.e., weight %) of the entire solid content in the image-forming layer, more preferably from 1 to 20 mass %. The content of the plasticizers is preferably from 0.1 to 20 mass % of the entire solid content in the image-forming layer, more preferably from 0.1 to 10 mass %.

(3) Others

In addition to the above components, the image-forming layer may further contain a surfactant, inorganic or organic fine particles (metallic powder and silica gel), oils (e.g., linseed oil and mineral oil), a thickener and an antistatic agent. Except for the case of obtaining a black image, energy necessary for transfer can be reduced by containing the materials which absorb the wavelength of the light sources for use in image recording. As the materials which absorb the wavelength of the light sources, either pigments or dyes may be used, but in the case of obtaining a color image, it is preferred in view of color reproduction to use dyes having less absorption in visible region and large absorption in the wavelength of light sources and use infrared light sources such as a semiconductor laser in image recording. As the examples of infrared absorbing dyes, the compounds disclosed in JP-A-3-103476 can be exemplified.

The image-forming layer can be provided by dissolving or dispersing the pigment and the binder, to thereby prepare a coating solution, coating the coating solution on the light-to-heat converting layer (when the following heat-sensitive peeling layer is provided on the light-to-heat converting layer, on the layer) and drying. As the solvent for use in the preparation of the coating solution, n-propyl alcohol, methyl ethyl ketone, propylene glycol monomethyl ether (MFG), methanol and water can be exemplified. Coating and drying can be performed according to ordinary coating and drying methods.

A heat-sensitive peeling layer containing a heat-sensitive material which generates gas by the action of the heat generated in the light-to-heat converting layer or releases adhesive moisture to thereby lower the adhesion strength between the light-to-heat converting layer and the image-forming layer can be provided on the light-to-heat converting layer of the heat transfer sheet. As such heat-sensitive materials, compounds (polymers or low molecular compounds) which themselves are decomposed by heat, or properties of which are changed by heat, and generate gas, and compounds (polymers or low molecular compounds) which are absorbing, or are being adsorbed with, a considerable amount of easily-gasifying gases, such as moisture, can be used. These compounds may be used in combination.

As the examples of the polymers which themselves are decomposed by heat, or properties of which are changed by heat, and generate gas, self oxidizing polymers, e.g., nitrocellulose, halogen-containing polymers, e.g., chlorinated polyolefin, chlorinated rubber, poly-rubber chloride, polyvinyl chloride, and polyvinylidene chloride, acryl-based polymers, e.g., polyisobutyl methacrylate which is being adsorbed with gasifying compound such as moisture, cellulose esters, e.g., ethyl cellulose which is being adsorbed with gasifying compound such as moisture, and natural high molecular compounds, e.g., gelatin which is being adsorbed with gasifying compound such as moisture can be exemplified. As the examples of low molecular compounds which are decomposed by heat, or properties of which are changed by heat, and generate gas, diazo compounds and azide compounds which generate heat, decomposed and generate gas can be exemplified.

Decomposition and property change by heat of the heat-sensitive material as described above preferably occur at 280° C. or less, particularly preferably 230° C. or less.

When low molecular compounds are used as the heat-sensitive material of the heat-sensitive peeling layer, it is preferred to combine the material with a binder. As the binder, the polymers which themselves are decomposed by heat, or properties of which are changed by heat, and generate gas, can be used, but ordinary binders which do not have such property can also be used. When the heat-sensitive low molecular compound is used in combination with a binder, the mass ratio (i.e., weight ratio) of the former to the latter is preferably from 0.02/1 to 3/1, more preferably from 0.05/1 to 2/1. It is preferred that the heat-sensitive peeling layer cover the light-to-heat converting layer almost entirely and the thickness of the heat-sensitive peeling layer is generally from 0.03 to 1 $\mu$m, and preferably from 0.05 to 0.5 $\mu$m.

When the constitution of the heat transfer sheet comprises a support having provided thereon a light-to-heat converting layer, a heat-sensitive peeling layer and an image-forming layer in this order, the heat-sensitive peeling layer is decomposed by heat conducted from the light-to-heat converting layer, or properties of which are changed by heat, and generates gas. The heat-sensitive peeling layer is partially lost or cohesive failure is caused in the heat-sensitive peeling layer due to the decomposition or gas generation, as a result the adhesion strength between the light-to-heat converting layer and the image-forming layer is lowered and, according to the behavior of the heat-sensitive peeling layer, a part of the heat-sensitive peeling layer migrates to the surface of the image finally formed with the image-forming layer and causes color mixing of the image. Therefore, it is preferred that the heat-sensitive peeling layer is scarcely colored, i.e., the heat-sensitive peeling layer shows high transmittance to visible rays, so that color mixing does not appear visually on the image formed, even if such transfer of the heat-sensitive peeling layer occurs.

Specifically, the absorptivity of the heat-sensitive peeling layer to visible rays is 50% or less, preferably 10% or less.

Further, instead of providing an independent heat-sensitive peeling layer, the heat transfer sheet may take the constitution such that the light-to-heat converting layer is formed by adding the heat-sensitive material to the coating solution of the light-to-heat converting layer, and the light-to-heat converting layer doubles as the heat-sensitive peeling layer.

It is preferred that the coefficient of static friction of the outermost layer of the heat transfer sheet of the side on which the image-forming layer is provided is 0.35 or less, preferably 0.20 or less. When the coefficient of static friction of the outermost layer is 0.35 or less, the contamination of the roll for carrying the heat transfer sheet can be suppressed and the quality of the image formed can be improved. The measurement of coefficient of static friction is according to the method disclosed in paragraph [0011] of JP-A-2001-47753.

It is preferred that the image-forming layer surface has a Smooster value (JAPAN TAPPI No.5) at 23° C., 55% RH of from 0.5 to 50 mmHg (=about 0.0665 to 6.65 kPa), and Ra of from 0.05 to 0.4 μm, which can reduce a great number of micro voids by which the image-receiving layer and the image-forming layer cannot be brought into contact with each other at the contact area, which is preferred in the point of transfer and image quality. The Ra value can be measured by a surface roughness meter (Surfcom, manufactured by Tokyo Seiki Co., Ltd.) according to JIS B0601. It is preferred that the surface hardness of the image-forming layer is 10 g or more when measured with a sapphire needle. When the image-forming layer is electrically charged according to U.S. test standard 4046 and then grounded, the electrification potential 1 second after grounding of the image-forming layer is preferably from −100 to 100 V. It is preferred that the surface resistance of the image-forming layer at 23° C., 55% RH is $10^9$ Ω or less.

In the next place, the image-receiving sheet which can be used in combination with the heat transfer sheet is described below.

Image-Receiving Sheet

Layer Constitution

The constitution of the image-receiving sheet generally comprises a support having provided thereon one or more image-receiving layer(s) and, if necessary, any one or two or more layer(s) of a cushioning layer, a peeling layer and an intermediate layer is(are) provided between the support and the image-receiving layer. It is preferred in view of conveyance to provide a backing layer on the surface of the support opposite to the side on which the image-receiving layer is provided.

Support

A plastic sheet, a metal sheet, a glass sheet, a resin-coated paper, a paper, and ordinary sheet-like substrate materials, e.g., various composites, are used as the support. As the examples of plastic sheets, a polyethylene terephthalate sheet, a polycarbonate sheet, a polyethylene sheet, a polyvinyl chloride sheet, a polyvinylidene chloride sheet, a polystyrene sheet, a styrene-acrylonitrile sheet, and a polyester sheet can be exemplified. As the examples of papers, an actual printing paper and a coated paper can be used.

It is preferred for the support to have minute voids in view of capable of improving the image quality. Such supports can be produced by mixing a thermoplastic resin and a filler comprising an inorganic pigment and a high polymer incompatible with the above thermoplastic resin to thereby prepare a mixed melt, extruding the mixed melt by a melt extruder to prepare a monolayer or multilayer film, and further monoaxially or biaxially stretching the film. In this step, the void ratio is determined by the selection of the resin and the filler, a mixing ratio and stretching condition.

As the thermoplastic resins, a polyolefin resin such as polypropylene and a polyethylene terephthalate resin are preferred, since they are excellent in crystallizability and orientation property and voids can be formed easily. It is preferred to use the polyolefin resin or the polyethylene terephthalate resin as the main component and use a small amount of other thermoplastic resin arbitrarily in combination. The inorganic pigments for use as the filler preferably have an average particle size of from 1 to 20 μm, e.g., calcium carbonate, clay, diatomaceous earth, titanium oxide, aluminum hydroxide and silica can be used. As the incompatible resins for use as the filler, when polypropylene is used as the thermoplastic resin, it is preferred to combine polyethylene terephthalate as the filler. The support having minute voids is disclosed in detail in JP-A-2001-105752.

The content of the filler, e.g., an inorganic pigment, in the support is generally from 2 to 30% or so by volume.

The thickness of the support in the image-receiving sheet is generally from 10 to 400 μm, preferably from 25 to 200 μm. For enhancing the adhesion with the image-receiving layer (or the cushioning layer) or with the image-forming layer in the heat transfer sheet, the surface of the support in the image-receiving sheet may be subjected to surface treatment, e.g., corona discharge treatment and glow discharge treatment.

Image-Receiving Layer

It is preferred to provide one or more image-receiving layer(s) on the support in the image-receiving sheet for transferring and fixing the image-forming layer on the image-receiving sheet. The image-receiving layer is preferably a layer formed with organic polymer binder as the main component. The binders are preferably thermoplastic resins, such as homopolymers and copolymers of acryl-based monomers, e.g., acrylic acid, methacrylic acid, acrylic ester, and methacrylic ester, cellulose-based polymers, e.g., methyl cellulose, ethyl cellulose and cellulose acetate, homomonomers and copolymers of vinyl-based monomers, e.g., polystyrene, polyvinyl pyrrolidone, polyvinyl butyral, polyvinyl alcohol and polyvinyl chloride, condensed polymers, e.g., polyester and polyamide, and rubber-based polymers, e.g., butadiene-styrene copolymer. The binder for use in the image-receiving layer is preferably a polymer having a glass transition temperature (Tg) of 90° C. or lower for obtaining appropriate adhesion with the image-forming layer. For that purpose, it is possible to added a plasticizer to the image-receiving layer. The binder polymer preferably has Tg of 30° C. or more for preventing blocking between sheets. As the binder polymer of the image-receiving layer, it is particularly preferred to use the same or analogous binder polymer in the image-forming layer from the point of improving the adhesion with the image-forming layer at laser recording and improving sensitivity and image strength.

It is preferred that the image-receiving layer surface has a Smooster value (JAPAN TAPPI No.5) at 23° C., 55% RH of from 0.5 to 50 mmHg (=about 0.0665 to 6.65 kPa), and Ra of from 0.05 to 0.4 μm, which can reduce a great number of micro voids by which the image-receiving layer and the image-forming layer cannot be brought into contact with each other at the contact area, which is preferred in the point of transfer and image quality. The Ra value can be measured by a surface roughness meter (Surfcom, manufactured by Tokyo Seiki Co., Ltd.) according to JIS B0601. When the image-receiving layer is electrically charged according to U.S. test standard 4046 and then grounded, the electrification potential 1 second after grounding of the image-receiving layer is preferably from −100 to 100 V. It is preferred that the surface resistance of the image-receiving layer at 23° C., 55% RH is $10^9$ Ω or less. It is preferred that the coefficient of static friction of the surface of the image-receiving layer is 0.2 or less. It is preferred that the surface energy of the surface of the image-receiving layer is from 23 to 35 mg/$m^2$.

When the image once formed on the image-receiving layer is re-transferred to the actual printing paper, it is also preferred that at least one image-receiving layer is formed of a photo-setting material. As the composition of such a photo-setting material, combination comprising a) a photopolymerizable monomer comprising at least one kind of a polyfunctional vinyl or vinylidene compound which can form a photo polymer by addition polymerization, b) an organic polymer, and c) a photopolymerization initiator, and, if necessary, additives, e.g., a thermal polymerization inhibitor can be exemplified. As the above polyfunctional vinyl monomer, unsaturated ester of polyol, in particular, an acrylic or methacrylic ester (ethylene glycol diacrylate, pentaerythritol tetraacrylate) is used.

As the organic polymer, the polymers for use for forming the image-receiving layer can be exemplified. As the photopolymerization initiator, an ordinary photo-radical polymerization initiator, e.g., benzophenone and Michler's ketone, can be used in proportion of from 0.1 to 20 mass % (i.e., weight %) in the layer.

The thickness of the image-receiving layer is generally from 0.3 to 7 μm, preferably from 0.7 to 4 μm. When the thickness of the image-receiving layer is 0.3 μm or more, the film strength can be ensured at re-transferring to the actual printing paper. While when it is 4 μm or less, the glossiness of the image after re-transferring to the actual printing paper can be suppressed, thus the approximation to the printed matter can be improved.

The Other Layers

A cushioning layer may be provided between the support and the image-receiving layer. When a cushioning layer is provided, it is possible to increase the adhesion of the image-forming layer and the image-receiving layer at heat transfer by laser and the image quality can be improved. Further, even if foreign matters enter between the heat transfer sheet and the image-receiving sheet during recording, the voids between the image-receiving layer and the image-forming layer are reduced by the deforming action of the cushioning layer, as a result the size of image defect such as clear spots can be made small. Further, when the image formed by transfer is re-transferred to the actual printing paper, since the surface of the image-receiving layer is deformed according to the surface unevenness of the paper, the transferring property of the image-receiving layer can be improved. Further, by reducing the glossiness of the transferred image, the approximation to the printed matter can be improved.

The cushioning layer is formed to be liable to be deformed when stress is laid on the image-receiving layer, hence for obtaining the above effect, the cushioning layer preferably comprises materials having a low modulus of elasticity, materials having elasticity of a rubber, or thermoplastic resins easily softened by heat. The modulus of elasticity of the cushioning layer at room temperature is preferably from 0.5 MPa to 1.0 GPa, more preferably from 1 MPa to 0.5 GPa, and particularly preferably from 10 to 100 MPa. For burying foreign matters such as dust, the penetration according to JIS K2530 (25° C., 100 g, 5 seconds) is preferably 10 or more. The cushioning layer has a glass transition temperature of 80° C. or less, preferably 25° C. or less, and a softening point of preferably from 50 to 200° C. It is also preferred to add a plasticizer to the binder for controlling these physical properties, e.g., Tg.

As the specific materials for use as the binder of the cushioning layer, besides rubbers, e.g., urethane rubber, butadiene rubber, nitrile rubber, acryl rubber and natural rubber, polyethylene, polypropylene, polyester, styrene-butadiene copolymer, ethylene-vinyl acetate copolymer, ethylene-acryl copolymer, vinyl chloride-vinyl acetate copolymer, vinylidene chloride resin, vinyl chloride resin containing a plasticizer, polyamide resin and phenol resin can be exemplified.

The thickness of the cushioning layer varies according to the resins used and other conditions, but is generally from 3 to 100 μm, preferably from 10 to 52 μm.

It is necessary that the image-receiving layer and the cushioning layer are adhered to each other until the stage of laser recording, but it is preferred that they are designed to be peelable for transferring an image to the actual printing paper. For easy peeling, it is also preferred to provide a peeling layer having a thickness of from 0.1 to 2 μm or so between the cushioning layer and the image-receiving layer. When the thickness of the peeling layer is too thick, the properties of the cushioning layer are difficult to be exhibited, thus it is necessary to adjust the thickness by the kind of the peeling layer.

The specific examples of the binders of the peeling layer include thermo-setting resins having Tg of 65° C. or more, e.g., polyolefin, polyester, polyvinyl acetal, polyvinyl formal, polyparabanic acid, methyl polymethacrylate, polycarbonate, ethyl cellulose, nitrocellulose, methyl cellulose, carboxymethyl cellulose, hydroxypropyl cellulose, polyvinyl alcohol, polyvinyl chloride, urethane resin, fluorine resin, styrenes, e.g., polystyrene and acrylonitrile styrene, crosslinked products of these resins, polyamide, polyimide, polyether imide, polysulfone, polyether sulfone, aramid, and hardened products of these resins. As the hardening agent, generally used hardening agents, e.g., isocyanate and melamine, can be used.

When the binders of the peeling layer is selected taking the above physical properties into consideration, polycarbonate, acetal and ethyl cellulose are preferred in view of the storage stability, and further, when acrylic resins are added to the image-receiving layer, peeling property at re-transferring of the image after laser heat transfer becomes good and preferred.

Further, a layer whose adhesion with the image-receiving layer extremely lowers by cooling can be used as the peeling layer. Specifically, layers containing waxes, heat fusion compounds such as binder, and thermoplastic resins as the main component can be used as such a layer.

The examples of the heat fusion compounds are disclosed in JP-A-63-193886. In particular, micro crystalline wax, paraffin wax, and carnauba wax are preferably used. As the thermoplastic resins, ethylene-based copolymers, e.g., ethylene-vinyl acetate resins and cellulose-based resins are preferably used.

As the additives, higher fatty acid, higher alcohol, higher fatty acid ester, amides, and higher amine can be added to the peeling layer, according to necessity.

As another constitution of the peeling layer, there is a layer which has peeling property by causing cohesive failure due to fusion or melting by heating. It is preferred to add a supercooling substance to such a peeling layer.

As the supercooling substance, poly-e-caprolactone, polyoxyethylene, benzotriazole, tribenzylamine and vanillin can be exemplified.

Still another constitution of the peeling layer, a compound to reduce the adhesion with the image-receiving layer is added. As such compounds, silicone-based resins, e.g., silicone oil; Teflon, fluorine-based resins, e.g., fluorine-containing acrylic resin; polysiloxane resins; acetal-based resins, e.g., polyvinyl butyral, polyvinyl acetal and polyvinyl formal; solid waxes, e.g., polyethylene wax and amide wax; and fluorine-based and phosphoric ester-based surfactants can be exemplified.

The peeling layer can be prepared by dissolving the above materials in a solvent or dispersing the above materials in a latex state, and coating on the cushioning layer by a blade coater, a roll coater, a bar coater, a curtain coater, or gravure coater, or extrusion lamination by hot melt. As another method, the solution or dispersion obtained by dissolving the above materials in a solvent or dispersing the above materials in a latex state is coated on a temporary base by the above coating method, the temporary base is adhered with the cushioning layer, and then the temporary base is peeled.

In the image-receiving sheet to be combined with the heat transfer sheet, the image-receiving layer may double as the cushioning layer, and in that case, the image-receiving sheet may take the constitution such as support/cushioning image-receiving layer, or support/undercoat layer/cushioning image-receiving layer. In this case, it is also preferred that cushioning image-receiving layer has peeling property so as to be able to re-transfer to the actual printing paper. In this case, the image after being re-transferred to the actual printing paper becomes a glossy image.

The thickness of the cushioning image-receiving layer is from 5 to 100 $\mu$m, preferably from 10 to 40 $\mu$m.

To provide a backing layer on the side of the support of the image-receiving sheet opposite to the side on which the image-receiving layer is provided is preferred for improving the traveling property of the image-receiving sheet. When a surfactant, an antistatic agent, e.g., fine particles of tin oxide, and a matting agent, e.g., silicon oxide and PMMA particles, are added to the backing layer, the traveling property in the recording unit is improved.

These additives can be added not only to the backing layer but also to the image-receiving layer and other layers, if necessary. The kinds of the additives cannot be prescribed unconditionally according to purposes, but an antistatic agent can be added by selecting arbitrarily from among various surfactants and electrically conductive agents so that the surface resistance of the layer at 23° C., 50% RH becomes preferably $10^{12}$ Ω or less, more preferably $10^{9}$ Ω or less.

As the binder for use in the backing layer, widely used polymers can be used, e.g., gelatin, polyvinyl alcohol, methyl cellulose, nitrocellulose, acetyl cellulose, aromatic polyamide resin, silicone resin, epoxy resin, alkyd resin, phenol resin, melamine resin, fluorine resin, polyimide resin, urethane resin, acryl resin, urethane-modified silicone resin, polyethylene resin, polypropylene resin, polyester resin, Teflon resin, polyvinyl butyral resin, vinyl chloride-based resin, polyvinyl acetate, polycarbonate, organic boron compounds, aromatic esters, polyurethane fluoride, and polyether sulfone can be used.

When crosslinkable water-soluble binder is used as the binder of the backing layer and crosslinked, dropout prevention of a matting agent and scratch resistance of the backing layer are improved, further it is effective for blocking during storage.

The crosslinking means can be selected with no limitation from heat, actinic rays and pressure, according to the characteristics of the crosslinking agent to be used, and these may be used alone or in combination. For providing an adhering property to the support, an arbitrary adhesion layer may be provided on the same side of the support on which the backing layer is provided.

The backing layer is preferably provided in an amount of about 0.5 to 5 g/m$^2$. When the amount is less than 0.5 g/m$^2$, coating property is unstable, and in heat transfer of thin image-forming layer, the dropout of the recorded image and unevenness are liable to occur.

It is preferred to add an antistatic agent to the backing layer for the purpose of preventing adhesion of foreign matters due to the friction with a carrier roller. As the antistatic agent, a cationic surfactant, an anionic surfactant, a nonionic surfactant, a high molecular antistatic agent, electrically conductive fine particles, in addition, the compounds described in 11290 *no Kagaku Shohin* (11290 *Chemical Commercial Products*), pp. 875 and 876, Kagaku Kogyo Nippo-Sha can be widely used.

As antistatic agents which can be used in the backing layer in combination, of the above compounds, metallic oxide, e.g., carbon black, zinc oxide, titanium oxide and tin oxide, and electrically conductive fine particles, e.g., organic semiconductors, are preferably used. In particular, when electrically conductive fine particles are used, the dissociation of the antistatic agent from the backing layer can be prevented, and stable antistatic effect can be obtained irrespective of the surroundings.

It is possible to add a mold-releasing agent, e.g., various activators, silicone oil, and fluorine resins, to the backing layer for providing a coating property and a mold-releasing property.

When the softening point of the cushioning layer and the image-receiving layer measured by TMA (Thermomechanical Analysis) is 70° C. or lower, it is particularly preferred for the backing layer.

TMA softening point is obtained by observing the phase of the object with increasing the temperature of the object of observation at constant rate and applying a constant load to the object. In the present invention, the temperature when the phase of the object begins to change is defined as TMA, softening point. In the measurement of a softening point by TMA, apparatus such as Thermoflex (manufactured by Rigaku Denki-Sha) can be used.

The heat transfer sheet and the image-receiving sheet can be used in image forming as the laminate superposing the image-forming layer in the heat transfer sheet and the image-receiving layer of the image-receiving sheet.

The laminate of the heat transfer sheet and the image-receiving sheet can be produced by various methods. For example, the laminate can be easily obtained by superposing the image-forming layer in the heat transfer sheet and the image-receiving layer in the image-receiving sheet and passing through a pressure and heating roller. The heating temperature at this time is 160° C. or less, preferably 130° C. or less.

The above-described vacuum adhesion method can also be preferably used for obtaining the laminate. The vacuum adhesion method is a method of winding the image-receiving sheet around the drum provided with suction holes for vacuum sucking, and then vacuum-adhering the heat transfer sheet of a little larger size than the image-receiving sheet on the image-receiving sheet with uniformly blasting air by a squeeze roller. As other method, a method of mechanically sticking the image-receiving sheet on the metal drum with pulling the image-receiving sheet, and further mechanically sticking the heat transfer sheet thereon with pulling in the same manner can also be used. Of these methods, the vacuum adhesion method is especially preferred in the point of requiring no temperature control and capable of effecting lamination rapidly and uniformly.

EXAMPLE

The present invention will be described in detail with reference to the examples below. In the examples, "parts" means "parts by mass" unless otherwise indicated.

Example 1-1

Preparation of Heat Transfer Sheet

Preparation of Heat Transfer Sheet K

Preparation of First Backing Layer Coating Solution

The coating solution of the first backing layer was prepared by adding distilled water to 3 parts of a binder (acrylate resin emulsion, Julymer E 410 (20%), manufactured by Nippon JunyakuCo., Ltd.),7.7parts of electrically conductive metallic oxide fine particles (acicular fine particles of tin oxide doped with antimony, FS-10 (20%), manufactured by Ishihara Sangyo Kaisha Ltd.), 0.2 parts of a crosslinking agent (epoxy compound, Dinacoal Ex614B, manufactured by Nagase Kasei Co., Ltd.), and 0.1 parts of a surfactant (polyoxyethylenephenyl ether) to make the total 100 parts.

Formation of First Backing Layer

One surface (back surface) of a biaxially stretched polyethylene terephthalate support having a thickness of 75 $\mu$m was subjected to corona discharge treatment. The first backing layer coating solution was coated on the support in a dry coating thickness of 0.03 $\mu$m, dried at 180° C. for 30 seconds, thereby the first backing layer was prepared. The Ra of the support of the side on which the image-forming layer side was provided was 0.01 $\mu$m. The Young's modulus of the support in the machine direction was 450 kg/mm$^2$ (=about 4.4 GPa), and the Young's modulus of the support in the transverse direction was 500 kg/mm$^2$ (=about 4.9 GPa). The F-5 value of the support in the machine direction was 10 kg/mm$^2$ (=about 98 MPa), and the F-5 value of the support in the transverse direction was 13 kg/mm$^2$ (=about 127.4 MPa), the heat shrinkage at 100° C. for 30 minutes of the support in the machine direction was 0.3%, and that in the transverse direction was 0.1%. The breaking strength in the machine direction was 20 kg/mm$^2$ (=about 196 MPa), and that in the transverse direction was 25 kg/mm$^2$ (=about 245 MPa), and the modulus of elasticity was 400 kg/mm$^2$ (=about 3.9 GPa).

Preparation of Second Backing Layer Coating Solution

The coating solution of the second backing layer was prepared by adding distilled water to 3 parts of a binder (polyolefin resin emulsion, Chemipearl S-120 (27%), manufactured by Mitsui Petrochemical Industries, Ltd.), 2 parts of colloidal silica (Snowtex C (20%), manufactured by Nissan Chemical Industries, Ltd.), 0.3 parts of a crosslinking agent (epoxy resin, Denacol EX-614B, manufactured by Nagase Kasei Co., Ltd.), and 0.1 parts of sodium polystyrenesulfonate to make the total 100 parts.

Formation of Second Backing Layer

The second backing layer coating solution was coated on the first backing layer in a dry coating thickness of 0.03 $\mu$m, dried at 170° C. for 30 seconds, thereby the second backing layer was prepared.

Preparation of Dispersion of Matting Agent

Ten parts of spherical silica fine particles having an average particle size of 1.5 $\mu$m (Seahostar-KE-P150, manufactured by Nippon Shokubai Co., Ltd.), 2 parts of dispersion polymer (acrylate-styrene copolymer, Joncryl 611, manufactured by Johnson Polymer Co., Ltd.), 16 parts of methyl ethyl ketone, and 64 parts of N-methylpyrrolidone were mixed, this mixture and 30 parts of glass beads having a diameter of 2 mm were put in a reaction vessel made of polyethylene having a capacity of 200 ml, and dispersed with a paint shaker (manufactured by Toyo Seiki Co., Ltd.) for 2 hours and silica fine particle dispersion was obtained.

Preparation of Light-to-Heat Converting Layer Coating Solution

Methyl ethyl ketone (20 parts), 73 parts of N-methylpyrrolidone, 0.4 parts of a binder (a 20% solution of polyimide resin, 8 parts of Rika Coat SN-20F manufactured by Shin Nihon Rika Co., Ltd., an infrared absorbing dye, NK-2014 manufactured by Nippon Kanko Shikiso Co., Ltd.), and a surfactant (Megafac F-177, manufactured by Dai-Nippon Ink & Chemicals, Inc.) were mixed to dissolve the binder and the infrared absorbing dye, and 0.7 parts of the above dispersion of the matting agent was added to the mixture, thereby a light-to-heat converting layer coating solution was prepared.

Formation of Light-to-Heat Converting Layer

The above-prepared light-to-heat converting layer coating solution was coated with a wire bar on the surface of the support (on the side opposite to the side on which the first and second backing layers were coated), dried at 120° C. for 3 minutes, thereby a light-to-heat converting layer was formed. The absorbance of the light-to-heat converting layer at wavelength of 808 nm was 1.09, and the layer thickness of the light-to-heat converting layer measured by a scanning electron microscope was 0.35 $\mu$m.

Formation of Image-Forming Layer

Preparation of Black Image-Forming Layer Coating Solution

Each of the following components was put in a kneading mill, and pre-treatment of dispersion was performed with adding a small amount of solvent and applying a shear force. A solvent was further added to the dispersion so as to reach the following composition, dispersion was performed for 2 hours in a sand mill, thereby the mother solution (i.e., the tank solution) of a pigment dispersion was obtained.

| Composition of black pigment dispersion mother solution | |
|---|---|
| Composition 1 | |
| Polyvinyl butyral (Eslec B BL-SH, manufactured by Sekisui Chemical Industries, Ltd.) | 12.6 parts |
| Pigment Black 7 (carbon black, C.I. No. 77266, Mitsubishi Carbon Black #5, manufactured by Mitsubishi Chemicals Co. Ltd., PVC blackness: 1) | 4.5 parts |
| Dispersion assistant (Solspers S-20000, manufactured by ICI) | 0.8 parts |
| n-Propyl alcohol | 79.4 parts |
| Composition 2 | |
| Polyvinyl butyral (Eslec B BL-SH, manufactured by Sekisui Chemical Industries, Ltd.) | 12.6 parts |
| Pigment Black 7 (carbon black, C.I. No. 77266, Mitsubishi Carbon Black MA100, manufactured by Mitsubishi Chemicals Co., Ltd., PVC blackness: 10) | 10.5 parts |
| Dispersion aid | 0.8 parts |

-continued

| Composition of black pigment dispersion mother solution | |
|---|---|
| (Solspers S-20000, manufactured by ICI) | |
| n-Propyl alcohol | 79.4 parts |

The following components were mixed with stirring by a stirrer to prepare a black image-forming layer coating solution.

| Composition of black image-forming layer coating solution | |
|---|---|
| Above black pigment dispersion mother solution (composition 1/composition 2: 70/30 (parts)) | 185.7 parts |
| Polyvinyl butyral (Eslec B BL-SH, manufactured by Sekisui Chemical Industries, Ltd.) | 11.9 parts |
| Wax-based compound | |
| Stearic acid amide (Newtron 2, manufactured by Nippon Seika Co., Ltd.) | 1.7 parts |
| Behenic acid amide (Diamid BM, (manufactured by Nippon Kasei Co., Ltd.) | 1.7 parts |
| Lauric acid amide (Diamid Y, (manufactured by Nippon Kasei Co., Ltd.) | 1.7 parts |
| Palmitic acid amide (Diamid KP, (manufactured by Nippon Kasei. Co., Ltd.) | 1.7 parts |
| Erucic acid amide (Diamid L-200, (manufactured by Nippon Kasei Co., Ltd.) | 1.7 parts |
| Oleic acid amide (Diamid O-200, (manufactured by Nippon Kasei Co., Ltd.) | 1.7 parts |
| Rosin (KE-311, (manufactured by Arakawa Kagaku Co., Ltd.) (components: resin acid 80–97%, resin acid components: abietic acid: 30 to 40% neoabietic acid: 10 to 20% dihydroabietic acid: 14% tetrahydroabietic acid: 14%) | 11.4 parts |
| Surfactant (Megafac F-176PF, solid content: 20%, manufactured by Dai-Nippon Ink & Chemicals, Inc.) | 2.1 parts |
| Inorganic pigment (MEK-ST, 30% methyl ethyl ketone solution, manufactured by Nissan Chemical Industries, Ltd.) | 7.1 parts |
| n-Propyl alcohol | 1,050 parts |
| Methyl ethyl ketone | 295 parts |

It was found that the particles in the thus-obtained black image-forming layer coating solution had an average particle size of 0.25 μm, and the ratio of the particles having a particle size of 1 μm or more was 0.5% from the measurement by particle size distribution measuring apparatus of laser scattering system.

Formation of Black Image-Forming Layer on Light-to-Heat Converting Layer

The above black image-forming layer coating solution was coated for 1 minute with a wire bar coater on the surface of the light-to-heat converting layer, and the coated product was dried in an oven at 100° C. for 2 minutes, thus a black image-forming layer was formed on the light-to-heat converting layer. By the above procedure, a heat transfer sheet (hereinafter referred to as heat transfer sheet K, similarly, a heat transfer sheet provided with a yellow image-forming layer is referred to as heat transfer sheet Y, a heat transfer sheet provided with a magenta image-forming layer is referred to as heat transfer sheet M, and a heat transfer sheet provided with a cyan image-forming layer is referred to as heat transfer sheet C) comprising a support having thereon a light-to-heat converting layer and a black image-forming layer in this order was prepared.

The transmitted optical density of the black image-forming layer of the thus-obtained heat transfer sheet K was 0.91 measured by Macbeth densitometer TD-904 (W filter), and the layer thickness of the black image-forming layer measured was 0.60 μm on average.

The obtained image-forming layer had the following physical properties.

The surface hardness of the image-forming layer with a sapphire needle having a diameter of 0.5 mm is preferably 100 g or more, specifically 200 g or more.

The Smooster value of the surface at 23° C., 55% RH is preferably from 0.5 to 50 mmHg (=about 0.0665 to 6.65 kPa), and specifically 9.3 mmHg (=about 1.24 kPa).

The coefficient of static friction of the surface is preferably 0.2 or less, and specifically 0.08.

The surface energy is 29 mJ/m$^2$, contact angle with water is 94.8°. The reflection optical density is 1.82, the layer thickness is 0.60 μm, and OD/layer thickness (μm unit) is 3.03.

The deformation rate of the light-to-heat converting layer was 168% when recorded at linear velocity of 1 m/sec or more with laser beams having light intensity at exposure surface of 1,000 W/mm$^2$ or more.

Preparation of Heat Transfer Sheet Y

Heat transfer sheet Y was prepared in the same manner as in the preparation of heat transfer sheet K, except that the yellow image-forming layer coating solution having the following composition was used in place of the black image-forming layer coating solution. The layer thickness of the image-forming layer of the obtained heat transfer sheet Y was 0.42 μm.

| Composition of yellow dispersion mother solution | |
|---|---|
| Composition of yellow pigment 1 | |
| Polyvinyl butyral (Eslec B BL-SH, manufactured by Sekisui Chemical Industries, Ltd.) | 7.1 parts |
| Pigment Yellow (pigment yellow 180, C.I. No. 21290) (Novoperm Yellow P-HG, manufactured by Clariant Japan, K. K.) | 12.9 parts |
| Dispersion assistant (Solspers S-20000, manufactured by ICI) | 0.6 parts |
| n-Propyl alcohol | 79.4 parts |

| Composition of yellow pigment dispersion mother solution | |
|---|---|
| Composition of yellow pigment 2 | |
| Polyvinyl butyral (Eslec B BL-SH, manufactured by Sekisui Chemical Industries, Ltd.) | 7.1 parts |
| Pigment Yellow 139 (carbon black, C.I. No. 56298) (Novoperm Yellow M2R 70, manufactured by Clariant Japan, K. K.) | 12.9 parts |
| Dispersion assistant | 0.6 parts |

-continued

| Composition of yellow pigment dispersion mother solution | |
|---|---|
| (Solspers S-20000, manufactured by ICI) | |
| n-Propyl alcohol | 79.4 parts |

| Composition of yellow image-forming layer coating solution | |
|---|---|
| Above yellow pigment dispersion mother solution (yellow pigment composition 1/ yellow pigment composition 2: 95/5 (parts)) | 126 parts |
| Polyvinyl butyral (Eslec B BL-SH, manufactured by Sekisui Chemical Industries, Ltd.) | 4.6 parts |
| Wax-based compound | |
| Stearic acid amide (Newtron 2, manufactured by Nippon Seika Co., Ltd.) | 0.7 parts |
| Behenic acid amide (Diamid BM, (manufactured by Nippon Kasei Co., Ltd.) | 0.7 parts |
| Lauric acid amide (Diamid Y, (manufactured by Nippon Kasei Co., Ltd.) | 0.7 parts |
| Palmitic acid amide (Diamid KP, (manufactured by Nippon Kasei Co., Ltd.) | 0.7 parts |
| Erucic acid amide (Diamid L-200, (manufactured by Nippon Kasei Co., Ltd.) | 0.7 parts |
| Oleic acid amide (Diamid O-200, (manufactured by Nippon Kasei Co., Ltd.) | 0.7 parts |
| Nonionic surfactant (Chemistat 1100, manufactured by Sanyo Chemical Industries, Co., Ltd.) | 0.4 parts |
| Rosin (KE-311, (manufactured by Arakawa Kagaku Co., Ltd.) | 2.4 parts |
| Surfactant (Megafac F-176PF, solid content: 20%, manufactured by Dai-Nippon Ink & Chemicals, Inc.) | 0.8 parts |
| n-Propyl alcohol | 793 parts |
| Methyl ethyl ketone | 198 parts |

The obtained image-forming layer had the following physical properties.

The surface hardness of the image-forming layer with a sapphire needle having a diameter of 0.5 mm is preferably 100 g or more, specifically 200 g or more.

The Smooster value of the surface at 23° C., 55% RH is preferably from 0.5 to 50 mmHg (=about 0.0665 to 6.65 kPa), and specifically 2.3 mmHg (=about 0.31 kPa).

The coefficient of static friction of the surface is preferably 0.2 or less, and specifically 0.1.

The surface energy is 24 mJ/m$^2$, contact angle with water was 108.1°. The reflection optical density is 1.01, the layer thickness is 0.42 $\mu$m, and OD/layer thickness ($\mu$m unit) is 2.40.

The deformation rate of the light-to-heat converting layer was 150% when recorded at linear velocity of 1 m/sec or more with laser beams having light strength at exposure surface of 1,000 W/mm$^2$ or more.

Preparation of Heat Transfer Sheet M

Heat transfer sheet M was prepared in the same manner as in the preparation of heat transfer sheet K, except that the magenta image-forming layer coating solution having the following composition was used in place of the black image-forming layer coating solution. The layer thickness of the image-forming layer of the obtained heat transfer sheet M was 0.38 $\mu$m.

| Composition of magenta pigment dispersion mother solution | |
|---|---|
| Composition of magenta pigment 1 | |
| Polyvinyl butyral (Denka Butyral #2000-L, manufactured by Denki Kagaku Kogyo Co., Ltd., Vicut softening point: 57° C.) | 12.6 parts |
| Pigment Red (pigment yellow 57:1, C.I. No. 15850:1) (Symuler Brilliant Carmine 6B-229, manufactured by Dainippon Chemicals and Ink Co., Ltd.) | 15.0 parts |
| Dispersion aid (Solspers S-20000, manufactured by ICI) | 0.6 parts |
| n-Propyl alcohol | 80.4 parts |

| Composition of magenta pigment dispersion mother solution | |
|---|---|
| Composition of magenta pigment 2 | |
| Polyvinyl butyral (Denka Butyral #2000-L, manufactured by Denki Kagaku Kogyo Co., Ltd., Vicut softening point: 57° C.) | 12.6 parts |
| Pigment Red 57:1 C.I. No. 15850:1) (Lionol Red 6B-4290G, manufactured by Toyo Ink Mfg. Co., Ltd.) | 15.0 parts |
| Dispersion aid (Solspers S-20000, manufactured by ICI) | 0.6 parts |
| n-Propyl alcohol | 79.4 parts |

| Composition of magenta image-forming layer coating solution | |
|---|---|
| Above magenta pigment dispersion mother solution 1 (magenta pigment composition 1/ magenta pigment composition 2:95/5 (parts)) | 163 parts |
| Polyvinyl butyral (Denka Butyral #2000-L, manufactured by Denki Kagaku Kogyo Co., Ltd., Vicut softening point: 57° C.) | 4.0 parts |
| Wax-based compound | |
| Stearic acid amide (Newtron 2, manufactured by Nippon Seika Co., Ltd.) | 1.0 parts |
| Behenic acid amide (Diamid BM, (manufactured by Nippon Kasei Co., Ltd.) | 1.0 parts |
| Lauric acid amide (Diamid Y, (manufactured by Nippon Kasei Co., Ltd.) | 1.0 parts |
| Palmitic acid amide (Diamid KP, (manufactured by Nippon Kasei Co., Ltd.) | 1.0 parts |
| Erucic acid amide (Diamid L-200, (manufactured by Nippon Kasei Co., Ltd.) | 1.0 parts |
| Oleic acid amide (Diamid O-200, (manufactured by Nippon Kasei Co., Ltd.) | 1.0 parts |
| Nonionic surfactant (Chemistat 1100, manufactured by Sanyo Chemical Industries, Co., Ltd.) | 0.7 parts |
| Rosin (KE-311, (manufactured by Arakawa Kagaku | 4.6 parts |

-continued

| Composition of magenta image-forming layer coating solution | |
|---|---|
| Co., Ltd.) | |
| Pentaerythritol tetraacrylate (NK ester A-TMMT, manufactured by Shin-Nakamura Kagaku Co., Ltd.) | 2.5 parts |
| Surfactant (Megafac F-176PF, solid content: 20%, manufactured by Dai-Nippon Ink & Chemicals, Inc.) | 1.3 parts |
| n-Propyl alcohol | 848 parts |
| Methyl ethyl ketone | 246 parts |

The obtained image-forming layer had the following physical properties.

The surface hardness of the image-forming layer with a sapphire needle having a diameter of 0.5 mm is preferably 100 g or more, specifically 200 g or more.

The Smooster value of the surface at 23° C., 55% RH is preferably from 0.5 to 50 mmHg (=about 0.0665 to 6.65 kPa), and specifically 3.5 mmHg (=about 0.47 kPa).

The coefficient of static friction of the surface is preferably 0.2 or less, and specifically 0.08.

The surface energy is 25 mJ/m$^2$, contact angle with water is 98.8°. The reflection optical density is 1.51, the layer thickness is 0.38 $\mu$m, and OD/layer thickness ($\mu$m unit) is 3.97.

The deformation rate of the light-to-heat converting layer was 160% when recorded at linear velocity of 1 m/sec or more with laser beams having light strength at exposure surface of 1,000 W/mm$^2$ or more.

Preparation of Heat Transfer Sheet C

Heat transfer sheet C was prepared in the same manner as in the preparation of heat transfer sheet K, except that the cyan image-forming layer coating solution having the following composition was used in place of the black image-forming layer coating solution. The layer thickness of the cyan-forming layer of the obtained heat transfer sheet C was 0.45 $\mu$m.

Composition of Cyan Pigment Dispersion Mother Solution

| Composition of cyan pigment 1 | |
|---|---|
| Polyvinyl butyral (Eslec B BL-SH, manufactured by Sekisui Chemical Industries, Ltd.) | 12.6 parts |
| Pigment Blue (pigment blue 54:7, C.I. No. 74160) (Cyanine Blue 700-10FG, manufactured by Toyo Ink Mfg. Co., Ltd.)) | 15.0 parts |
| Dispersion aid (PW-36, manufactured by Kusumoto Kasei Co., Ltd.) | 0.8 parts |
| n-Propyl alcohol | 110 parts |

Composition of Cyan Pigment Dispersion Mother Solution

| Composition of cyan pigment 2 | |
|---|---|
| Polyvinyl butyral (Eslec B BL-SH, manufactured by Sekisui Chemical Industries, Ltd.) | 12.6 parts |
| Pigment Blue 15 (C.I. No. 74160, Lionol Blue 7027, manufactured by Toyo Ink Mfg. Co., Ltd.) | 15.0 parts |
| Dispersion aid (PW-36, manufactured by Kusumoto Kasei Co., Ltd.) | 0.8 parts |
| n-Propyl alcohol | 110 parts |

-continued

| Composition of cyan image-forming layer coating solution | |
|---|---|
| Above cyan pigment dispersion mother solution (cyan pigment composition 1/ cyan pigment composition 2:90/10 (parts)) | 118 parts |
| Polyvinyl butyral (Eslec B BL-SH, manufactured by Sekisui Chemical Industries, Ltd.) | 5.2 parts |
| Inorganic pigment (MEK-ST) | 1.3 parts |
| Wax-based compound | |
| Stearic acid amide (Newtron 2, manufactured by Nippon Seika Co., Ltd.) | 1.0 parts |
| Behenic acid amide (Diamid BM, (manufactured by Nippon Kasei Co., Ltd.) | 1.0 parts |
| Lauric acid amide (Diamid Y, (manufactured by Nippon Kasei Co., Ltd.) | 1.0 parts |
| Palmitic acid amide (Diamid KP, (manufactured by Nippon Kasei Co., Ltd.) | 1.0 parts |
| Erucic acid amide (Diamid L-200, (manufactured by Nippon Kasei Co., Ltd.) | 1.0 parts |
| Oleic acid amide (Diamid O-200, (manufactured by Nippon Kasei Co., Ltd.) | 1.0 parts |
| Rosin (KE-311, (manufactured by Arakawa Kagaku Co., Ltd.) | 2.8 parts |
| Pentaerythritol tetraacrylate (NK ester A-TMMT, manufactured by Shin-Nakamura Kagaku Co., Ltd.) | 1.7 parts |
| Surfactant (Megafac F-176PF, solid content: 20%, manufactured by Dai-Nippon Ink & Chemicals, Inc.) | 1.7 parts |
| n-Propyl alcohol | 890 parts |
| Methyl ethyl ketone | 247 parts |

The obtained image-forming layer had the following physical properties.

The surface hardness of the image-forming layer with a sapphire needle having a diameter of 0.5 mm is preferably 100 g or more, specifically 200 g or more.

The Smooster value of the surface at 23° C., 55% RH is preferably from 0.5 to 50 mmHg (=about 0.0665 to 6.65 kPa), and specifically 7.0 mmHg (=about 0.93 kPa).

The coefficient of static friction of the surface is preferably 0.2 or less, and specifically 0.08.

The surface energy is 25 mJ/m$^2$, contact angle with water was 98.8°. The reflection optical density is 1.59, the layer thickness is 0.45 $\mu$m, and OD/layer thickness ($\mu$m unit) is 3.53.

The deformation rate of the light-to-heat converting layer was 165% when recorded at linear velocity of 1 m/sec or more with laser beams having light strength at exposure surface of 1,000 W/mm$^2$ or more.

Preparation of Image-Receiving Sheet

The cushioning layer coating solution and the image-receiving layer coating solution each having the following composition were prepared.

| 1) Cushioning layer coating solution | |
|---|---|
| Vinyl chloride-vinyl acetate copolymer (main binder, MPR-TSL, manufactured by Nisshin Kagaku Co., Ltd.) | 20 parts |
| Plasticizer (Paraplex G-40, manufactured by CP. HALL. COMPANY) | 10 parts |
| Surfactant (fluorine surfactant, coating assistant, Megafac F-177, manufactured by Dainippon Chemicals and Ink Co., Ltd.) | 0.5 parts |
| Antistatic agent (quaternary ammonium salt, SAT-5 Supper (IC), manufactured by Nippon Junyaku Co., Ltd.) | 0.3 parts |
| Methyl ethyl ketone | 60 parts |
| Toluene | 10 parts |
| N,N-Dimethylformamide | 3 parts |

| 2) Image-receiving layer coating solution | |
|---|---|
| Polyvinyl butyral (Eslec B BL-SH, manufactured by Sekisui Chemical Industries, Ltd.) | 8 parts |
| Antistatic agent Sanstat 2012A, manufactured by Sanyo Chemical Industries, Co., Ltd.) | 0.7 parts |
| Surfactant (Megafac F-177, manufactured by Dai-Nippon ink & Chemicals, Inc.) | 0.1 parts |
| n-Propyl alcohol | 20 parts |
| Methanol | 20 parts |
| 1-Methoxy-2-propanol | 50 parts |

The above-prepared cushioning layer coating solution was coated on a white PET support (Lumiler #130E58, manufactured by Toray Industries Inc., thickness: 130 μm) using a narrow-broad coater and the coated layer was dried, and then the image-receiving layer coating solution was coated and dried. The coating amounts were controlled so that the layer thickness of the cushioning layer after drying became about 20 μm and the layer thickness of the image-receiving layer became about 2 μm. The white PET support was a void-containing plastic support of alaminate (total thickness: 130 μm, specific gravity: 0.8) comprising a void-containing polyethylene terephthalate layer (thickness: 116 μm, void ratio: 20%), and titanium oxide-containing polyethylene terephthalate layers provided on both sides thereof (thickness: 7 μm, titanium oxide content: 2%). The prepared material was wound in a roll, stored at room temperature for one week, then used in the image recording by laser beam as shown below.

The obtained image-receiving layer had the following physical properties.

The surface roughness Ra is preferably from 0.4 to 0.01 μm, and specifically 0.02 μm.

The undulation of the surface of the image-receiving layer is preferably 2 μm or less, and specifically 1.2 μm.

The Smooster value of the surface of the image-receiving layer at 23° C., 55% RH is preferably from 0.5 to 50 mmHg (=about 0.0665 to 6.65 kPa), and specifically 0.8 mmHg (=about 0.11 kPa).

The coefficient of static friction of the surface of the image-receiving layer is preferably 0.8 or less, and specifically 0.37.

The surface energy of the surface of the image-receiving layer is 29 mJ/m$^2$, contact angle with water is 87.0°.

Comparative Example 1-1

Various kinds of heat transfer sheets were prepared in the same manner as in Example 1-1 except that dispersion polymer (Joncryl 611) was not used in the preparation of the dispersion of matting agent. The image-receiving sheet was the same as in Example 1-1.

Example 1-2

Various kinds of heat transfer sheets were prepared in the same manner as in Example 1-1 except that a surfactant (phosphoric acid ester based surfactant PW-36, manufactured by Kusumoto Kasei Co., Ltd.) was used in place of Joncryl 611 (manufactured by Johnson Polymer Co., Ltd.). The image-receiving sheet was the same as in Example 1-1.

Example 1-3

Various kinds of heat transfer sheets were prepared in the same manner as in Example 1-1 except that dispersion polymer (Solspers S-20000, manufactured by ICI) was used in place of Joncryl 611 (manufactured by Johnson Polymer Co., Ltd.). The image-receiving sheet was the same as in Example 1-1 .

The stability of each light-to-heat converting layer coating solution and the property of the image-forming material were evaluated as follows. The results obtained are shown in Table 1 below.

Example 1-4

Preparation of Image-Receiving Sheet

The cushioning layer coating solution having the following composition and the image-receiving layer coating solution were prepared.

1) Cushioning Layer Coating Solution

The same as in Example 1-1.

| 2) Image-receiving layer coating solution | |
|---|---|
| Polyvinyl butyral (Eslec B BL-SH, manufactured by Sekisui Chemical Industries, Ltd.) | 8 parts |
| Antistatic agent Sanstat 2012A, manufactured by Sanyo Chemical Industries, Co., Ltd.) | 0.7 parts |
| Surfactant (Megafac F-177, manufactured by Dainippon Chemicals and Ink Co., Ltd.) | 0.1 parts |
| n-Propyl alcohol | 20 parts |
| Methanol | 20 parts |
| 1-Methoxy-2-propanol | 50 parts |

The above components were mixed and polyvinyl butyral was dissolved, and 0. 8 parts of the dispersion of the matting agent used in Example 1-1 was added thereto, thereby an image-receiving layer coating solution was prepared.

The above-prepared cushioning layer coating solution was coated with a wire bar on a white PET support (Lumiler #130E58, manufactured by Toray Industries Inc., thickness: 130 μm) using a narrow-broad coater with wire bar and the coated layer was dried, and then the image-receiving layer coating solution was coated and dried. The dry coating amount of the cushioning layer was about 20 μm and that of the image-receiving layer measured with a scanning electron microscope was 2.1 μm. The prepared material was wound in a roll, stored at room temperature for one week, then used in the image recording by laser beam as shown below.

The obtained image-receiving layer had the following physical properties.

The surface roughness Ra is 0.3 μm, the undulation of the surface of the image-receiving layer is 1.1 μm, and the Smooster value of the surface of the image-receiving layer is 2.7 mmHg (=about 0.36 kPa), and the coefficient of static friction of the surface of the image-receiving layer is 0.12.

The same heat transfer sheet as in Comparative Example 1-1 was used.

Comparative Example 1-2

An image-receiving sheet was prepared in the same manner as in Example 1-4 except that dispersion polymer (Joncryl 611) was not used in the preparation of the dispersion of the matting agent.

The same heat transfer sheet as in Comparative Example 1-1 was used.

Evaluation of Stability of Coating Solution

With respect to the light-to-heat-converting layer coating solutions in Examples 1-1 to 1-3 and Comparative Example 1-1, or the image-receiving layer coating solutions in Examples 1-1 to 1-4 and Comparative Example 1-2, each solution was coated immediately after preparation and after being allowed to stand at 25° C. for 2 hours to prepare a light-to-heat-converting layer or an image-receiving layer. The state of cohesion of the matting agent in the coated layer was observed with an optical microscope. The results of observation were classified into four ranks. Those which are classified into Ranks A and B are practicable.

Rank A: Almost all the particles are dispersed disjointedly one by one.

Rank B: A part of the particles are dispersed cohesively by twos and threes.

Rank C: Almost all the particles are dispersed cohesively by twos and threes.

Rank D: Almost all the particles are dispersed cohesively by twos and threes, and five or more particles cohere partly.

Performance of Multicolor Image-Forming Material

Multicolor Image-Forming Material in Example 1-1

Formation of Transferred Image

A transferred image to actual paper was obtained by the image-forming system shown in FIG. 4 according to the image-forming sequence of the system and the transfer method to actual paper of the system, and Luxel FINAL-PROOF 5600 was used as the recording unit.

The above-prepared image-receiving sheet (56 cm×79 cm) was wound around the rotary drum having a diameter of 38 cm, provided with vacuum suction holes having a diameter of 1 mm (a real density of 1 hole in the area of 3 cm×8 cm) and vacuum-adsorbed. Subsequently, the above heat transfer sheet K (black) cut into a size of 61 cm×84 cm was superposed on the image-receiving sheet so as to deviate uniformly, squeezed by a squeeze roller, and adhered and laminated so that air was sucked by suction holes. The degree of pressure reduction in the state of suction holes being covered was −150 mmHg per 1 atm (=about 81.13 kPa). The drum was rotated and semiconductor laser beams of the wavelength of 808 nm were condensed from the outside on the surface of the laminate on the drum so that the laser beams became a spot of a diameter of 7 μm on the surface of the light-to-heat converting layer, and laser image recording (line image) was performed on the laminate by moving the laser beam at a right angle (subsidiary scanning ) to the rotary direction of the drum (main scanning direction). The condition of irradiation was as follows. The laser beams used in the example was multi-beam two dimensional array comprising five rows along the main scanning direction and three rows along the subsidiary scanning direction.

Laser power: 110 mW

Drum rotation speed: 500 rpm

Subsidiary scanning pitch: 6.35 μm

Surrounding temperature condition:

18° C. 30%, 23° C. 50%, 26° C. 65%

The diameter of exposure drum is preferably 360 mm or more, specifically 380 mm was used.

The size of the image was 515 mm×728 mm, and the definition was 2,600 dpi.

The laminate finished laser recording was detached from the drum and heat transfer sheet K was peeled from the image-receiving sheet by hands. It was confirmed that only the irradiated domain of the image-forming layer of heat transfer sheet K had been transferred from heat transfer sheet K to the image-receiving sheet.

In the same manner as above, the image was transferred to the image-receiving sheet from each of heat transfer sheet Y, heat transfer sheet M and heat transfer sheet C. The transferred images of four colors were further transferred to a recording paper and a multicolor image was formed. Even when high energy laser recording was performed under different temperature humidity conditions with laser beams of multi-beam two dimensional array, a multicolor image having excellent image quality and stable transfer density could be formed.

In the stage of transfer to the actual paper, the heat transfer unit having a dynamic friction coefficient against insert-receiving table of polyethylene terephthalate of from 0.1 to 0.7 and traveling speed of from 15 to 50 mm/sec was used. The Vickers hardness of the heat roller of the heat transfer unit is preferably from 10 to 100, and specifically the heat roller having Vickers hardness of 70 was used.

Every image under three different surroundings of temperature humidity conditions was good.

Further, the clear spots per $m^2$ of the multicolor image transferred to recording paper was evaluated. The clear spots mean a blank having a diameter of 1 mm or larger when observed visually.

The multicolor image-forming materials in other Examples and Comparative Examples were also evaluated in the same manner as in Example 1-1. The results obtained are shown in Table 1 below.

TABLE 1

| | Stability of Coating Solution | | |
|---|---|---|---|
| Example No. | Stability Immediately after Preparation | Stability after Being Allowed for 24 Hours | White Blank Area |
| Example 1-1 | A | A | $0/m^2$ |
| Comparative Example 1-1 | B | D | $24/m^2$ |
| Example 1-2 | A | A | $1/m^2$ |
| Example 1-3 | A | A | $2/m^2$ |
| Example 1-4 | A | A | $0/m^2$ |
| Comparative Example 1-2 | B | D | $4/m^2$ |

Example 2-1

Preparation of Heat Transfer Sheet K (Black)

Formation of Backing Layer

| Preparation of first backing layer coating solution | |
|---|---|
| Water dispersion solution of acrylate resin (Julymer ET410, solid content: 20 mass % (i.e., weight %), manufactured by Nippon Junyaku Co., Ltd.) | 2 parts |
| Antistatic agent (water dispersion of tin oxide-antimony oxide, average particle size: 0.1 μm, 17 mass %) | 7.0 parts |
| Polyoxyethylenephenyl ether | 0.1 part |
| Melamine compound (Sumitic Resin M-3, manufactured by Sumitomo Chemical Industry Co., Ltd.) | 0.3 parts |
| Distilled water to make the total amount | 100 parts |

Formation of First Backing Layer

One surface (back surface) of a biaxially stretched polyethylene terephthalate support having a thickness of 75 μm was subjected to corona discharge treatment. The first backing layer coating solution was coated on the support in a dry coating thickness of 0.03 μm, dried at 180° C. for 30 seconds, thereby the first backing layer was prepared. The Young's modulus of the support in the machine direction was 450 kg/mm$^2$ (=about 4.4 GPa), and the Young's modulus of the support in the transverse direction was 500 kg/mm$^2$ (=about 4.9 GPa). The F-5 value of the support in the machine direction was 10 kg/mm$^2$ (=about 98 MPa), and the F-5 value of the support in the transverse direction was 13 kg/mm$^2$ (=about 127.4 MPa), the heat shrinkage at 100° C. for 30 minutes of the support in the machine direction was 0.3%, and that in the transverse direction was 0.1%. The breaking strength was 20 kg/mm$^2$ (=about 196 MPa) in the machine direction, and that in the transverse direction was 25 kg/mm$^2$ (=about245 MPa), and the modulus of elasticity was 400 kg/mm$^2$ (=about 3.9 GPa).

| Preparation of second backing layer coating solution | |
|---|---|
| Polyolefin (Chemipearl S-120, 27 mass %, manufactured by Mitsui Petrochemical Industries, Ltd.) | 3.0 parts |
| Antistatic agent (water dispersion of tin oxide-antimony oxide, average particle size: 0.1 μm, 17 mass %) | 2.0 parts |
| Colloidal silica (Snowtex C, 20 mass %, manufactured by Nissan Chemical Industries, Ltd.) | 2.0 parts |
| Epoxy resin (Denacol EX-614B, manufactured by Nagase Kasei Co., Ltd.) | 0.3 parts |
| Distilled water to make the total amount | 100 parts |

Formation of Second Backing Layer

The second backing layer coating solution was coated on the first backing layer in dry coating thickness of 0.03 μm, dried at 170° C. for 30 seconds, thereby the second backing layer was prepared.

Formation of Light-to-Heat Converting Layer

Preparation of Light-to-Heat Converting Layer Coating Solution

The following components were mixed with stirring by a stirrer and the light-to-heat converting layer coating solution was prepared.

| Composition of light-to-heat converting layer coating solution | |
|---|---|
| Infrared absorbing dye (NK-2014, manufactured by Nippon Kanko Shikiso Co., Ltd., cyanine dye having the following composition) | 7.6 parts |

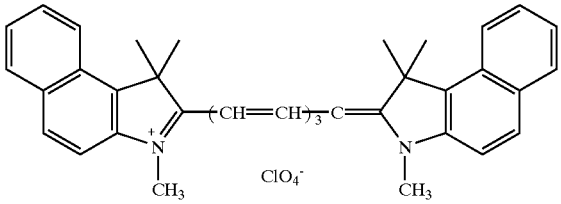

| | |
|---|---|
| Polyimide resin represented by the following formula (Rika Coat SN-20F, manufactured by Shin Nihon Rika K. K., heat decomposition temperature: 510° C.) | 29.3 parts |

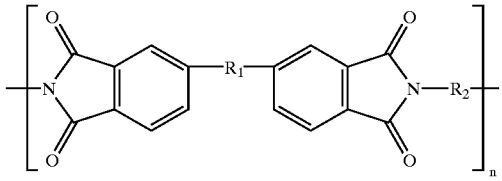

In the formula, $R_1$ represents $SO_2$, $R_2$ represents the following formula:

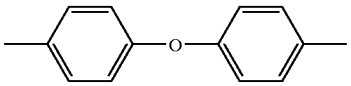

or

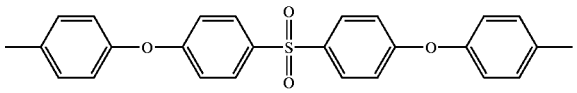

| | |
|---|---|
| Exson naphtha | 5.8 parts |
| N-Methylpyrrolidone (NMP) | 1,500 parts |
| Methyl ethyl ketone | 360 parts |
| Surfactant (Megafac F-176PF, manufactured by Dainippon Chemicals and Ink Co., Ltd., fluorine surfactant) | 0.5 parts |
| Dispersion of matting agent having the following composition | 14.1 parts |

Preparation of Dispersion of Matting Agent

Ten parts of spherical silica fine particles having an average particle size of 1.5 μm (Seahoster-KE-P150, manufactured by Nippon Shokubai Co., Ltd.), 2 parts of dispersion polymer (acrylate-styrene copolymer, Joncryl 611, manufactured by Johnson Polymer Co., Ltd.), 16 parts of methyl ethyl ketone, and 64 parts of N-methylpyrrolidone were mixed, this mixture and 30 parts of glass beads having a diameter of 2 mm were put in a reaction vessel made of polyethylene having a capacity of 200 ml, and dispersed with a paint shaker (manufactured by Toyo Seiki Co., Ltd.) for 2 hours and silica fine particle dispersion was obtained.

Formation of Light-to-Heat Converting Layer on Support Surface

The above light-to-heat converting layer coating solution was coated with a wire bar coater on one surface of a polyethylene terephthalate film (support) having a thickness of 75 μm, and the coated product was dried in an oven at 120° C. for 2 minutes, thus a light-to-heat converting layer was formed on the support. The optical density (OD) of the thus-obtained light-to-heat converting layer at wavelength of 808 nm measured by UV-spectrophotometer UV-240 (manufactured by Shimadzu Seisakusho Co. Ltd.) was 1.03, and the layer thickness measured by a scanning electron microscope was 0.3 μm on average.

Subsequently, the same black image-forming layer as in Example 1-1 was formed on the light-to-heat converting layer, thus heat-transfer sheet K was prepared.

In the similar manner, the same yellow, magenta or cyan image-forming layer as in Example 1-1 was formed on the light-to-heat converting layer, thus heat-transfer sheet Y, M or C was prepared.

The same image-receiving sheet as in Example 1-1 was used.

The transferred image was obtained using the multicolor image-forming material in Example 2-1 by the same image-forming system as in Example 1-1.

That is, the above-prepared image-receiving sheet (56 cm×79 cm) was wound around the rotary drum having a diameter of 38 cm, provided with vacuum suction holes having a diameter of 1 mm (a real density of 1 hole in the area of 3 cm×8 cm) and vacuum-adsorbed. Subsequently, the above heat transfer sheet K (black) cut into a size of 61 cm×84 cm was superposed on the image-receiving sheet so as to deviate uniformly, squeezed by a squeeze roller, and adhered and laminated so that air was sucked by suction holes. The degree of pressure reduction in the state of suction holes being covered was −150 mmHg per 1 atm(= about 81.13 kPa). The drum was rotated and semiconductor laser beams of the wavelength of 808 nm were condensed from the outside on the surface of the laminate on the drum so that the laser beams became a spot of a diameter of 7 μm on the surface of the light-to-heat converting layer, and laser image recording (line image) was performed on the laminate by moving the laser beam at a right angle (subsidiary scanning ) to the rotary direction of the drum (main scanning direction). The condition of irradiation was as follows. The laser beams used in the example was multi-beam two dimensional array comprising five rows along the main scanning direction and three rows along the subsidiary scanning direction.

Laser power: 110 mW

Drum rotation speed: 500 rpm

Subsidiary scanning pitch: 6.35 μm

Surrounding temperature condition:

18° C. 30%, 23° C. 50%, 26° C. 65%

The diameter of exposure drum is preferably 360 mm or more, specifically 380 mm was used.

The size of the image was 515 mm×728 mm, and the definition was 2,600 dpi.

The laminate finished laser recording was detached from the drum and heat transfer sheet K was peeled from the image-receiving sheet by hands. It was confirmed that only the irradiated domain of the image-forming layer of heat transfer sheet K had been transferred from heat transfer sheet K to the image-receiving sheet.

In the same manner as above, the image was transferred to the image-receiving sheet from each of heat transfer sheet Y, heat transfer sheet M and heat transfer sheet C. The transferred images of four colors were further transferred to a recording paper and a multicolor image was formed. Even when high energy laser recording was performed under different temperature humidity conditions with laser beams of multi-beam two dimensional array, a multicolor image having excellent image quality and stable transfer density could be formed.

In the stage of transfer to the actual paper, the heat transfer unit having a dynamic friction coefficient against insert-receiving table of polyethylene terephthalate of from 0.1 to 0.7 and traveling speed of from 15 to 50 mm/sec was used. The Vickers hardness of the heat roller of the heat transfer unit is preferably from 10 to 100, and specifically the heat roller having Vickers hardness of 70 was used.

Every image under three different surroundings of temperature humidity conditions was good.

As the optical density, the reflection optical density of each color of Y, M, C, K of the image transferred to Tokuryo art paper was measured in Y, M, C, K mode with a densitometer X-rite 938 (manufactured by X-rite Co.).

Optical density, optical density/image-forming layer thickness (μm) of each color are the same as in Example 1-1 as shown in Table 2 below.

TABLE 2

| Color | Optical Density | Optical Density/Image-Forming Layer Thickness |
|---|---|---|
| Y | 1.01 | 2.40 |
| M | 1.51 | 3.97 |
| C | 1.59 | 3.53 |
| K | 1.82 | 3.03 |

The transferred image formed under 23° C. 50% RH was evaluated as follows.

Evaluation of Black Image Quality

Using heat transfer sheet K, the image quality of the solid part and the line image part of the transferred image obtained under each temperature-humidity condition was observed with an optical microscope. The time lag in the solid part was not observed in every surrounding condition, the line definition of the line image was good, and transferred black images having less dependency on the surrounding condition could be obtained. The evaluation was performed visually according to the following criteria.

Solid Part

○: Time lag in recording time and transfer failure were not observed.

Δ: Time lag in recording time and transfer failure were observed partially.

x: Time lag in recording time and transfer failure were observed all over the surface.

Line Image Part

○: The edge of the line image part was sharp and good definition was shown.

Δ: The edge of the line image part was jagged and bridging occurred partially.

x: Bridging occurred entirely.

Evaluation of Unevenness

Four color images transferred to a recording paper were visually observed and unevenness was evaluated according to the following criteria.

○: Unevenness was not observed at all.

Δ: Unevenness was observed partially.

x: Unevenness was observed on 50% or more of the image area.

Evaluation of Surface Hardness of Image-Forming Layer

When the surface of the image-forming layer before image formation is scratched with a sapphire needle having a diameter of 0.5 mm at a speed of 1 cm/sec with varying the load, the value represented by gram unit of the minimum load required for the sapphire needle to break the image-forming layer and reach the light-to-heat converting layer is taken as the hardness of the image-forming layer. This value indicates the scratch resistance of the image-forming layer.

Evaluation of Stability of Coating Solution

After 50 ml of thoroughly stirred light-to-heat converting layer coating solution was poured into a measuring cylinder having an inside diameter of 20 mm and allowed to stand at 25° C. for 30 minutes, whether fine particles were precipitated or not at the bottom of the measuring cylinder was evaluated.

○: Precipitation of fine particles was not observed.
x: Precipitation of fine particles was observed.

The results of evaluations are shown in Tables 3 and 4 below.

Example 2-2

A heat transfer sheet was prepared in the same manner as in Example 2-1 except that the amount of the pigment of each of yellow, magenta, cyan and black image-forming layers was made 0.8 times the amount in Example 2-1. However, the optical density of the image-forming layer was made the same with that in Example 2-1. The image-receiving sheet in Example 1-1 was used.

Reference Example 2-1

A heat transfer sheet was prepared in the same manner as in Example 2-1 except that amorphous fine particles having an La value of 3.5 were used in place of the spherical silica fine particles in the dispersion of the matting agent for use in the light-to-heat converting layer coating solution. The image-receiving sheet in Example 1-1 was used.

Reference Example 2-2

A heat transfer sheet was prepared in the same manner as in Example 2-1 except that spherical fine particles having an average particle size of 0.05 μm were used in place of the spherical silica fine particles (an average particle size Lb=1.5 μm) in the dispersion of the matting agent for use in the light-to-heat converting layer coating solution. The image-receiving sheet in Example 1-1 was used.

Reference Example 2-3

A heat transfer sheet was prepared in the same manner as in Example 2-1 except that spherical fine particles having an average particle size Lb=5.0 μm were used in place of the spherical silica fine particles (an average particle size Lb=1.5 μm) in the dispersion of the matting agent for use in the light-to-heat converting layer coating solution. The image-receiving sheet in Example 1-1 was used.

Reference Example 2-4

A heat transfer sheet was prepared in the same manner as in Example 2-1 except that spherical fine particles having $L_{25}/L_{75}$ value of 3.2 and an average particle size Lb=1.5 μm were used in place of the spherical silica fine particles ($L_{25}/L_{75}$ value of 1.1) in the dispersion of the matting agent for use in the light-to-heat converting layer coating solution. The image-receiving sheet in Example 1-1 was used.

Example 2-5

A heat transfer sheet was prepared in the same manner as in Example 2-1 except that the amount of the pigment of each of yellow, magenta, cyan and black image-forming layers was made 0.6 times the amount in Example 2-1. However, the optical density of the image-forming layer was made the same with that in Example 2-1. The image-receiving sheet in Example 1-1 was used.

Example 2-6

A heat transfer sheet was prepared in the same manner as in Example 2-1 except that the amount of the pigment of each of yellow, magenta, cyan and black image-forming layers was made 0.5 times the amount in Example 2-1. However, the optical density of the image-forming layer was made the same with that in Example 2-1. The image-receiving sheet in Example 1-1 was used.

Each of the heat transfer sheet prepared in Example 2-2 and Comparative Examples 2-1 to 2-6 was also evaluated in the same manner as in Example 1-1. The results obtained are shown in Tables 3 and 4 below.

The reference examples are an example for exhibiting the effect due to using or not using the spherical fine particle.

TABLE 3

| | Fine Particles | | | | |
|---|---|---|---|---|---|
| Example No. | Shape | Average Particle Size (μm) | Grain Size Distribution | Specific Gravity | Crystallizability |
| Example 2-1 | spherical | 1.5 | 1.1 | 1.2 | amorphous |
| Example 2-2 | spherical | 1.5 | 1.1 | 1.2 | amorphous |
| Reference Example 2-1 | irregular | 1.5 | 1.1 | 1.2 | amorphous |
| Reference Example 2-2 | spherical | 0.05 | 1.1 | 1.2 | amorphous |
| Reference Example 2-3 | spherical | 5.0 | 1.1 | 1.2 | amorphous |
| Reference Example 2-4 | spherical | 1.5 | 3.2 | 1.2 | amorphous |
| Reference Example 2-5 | spherical | 1.5 | 1.1 | 1.2 | amorphous |
| Reference | spherical | 1.5 | 1.1 | 1.2 | amorphous |

TABLE 3-continued

Example 2-6

| Example No. | OD/Layer Thickness (μm) | | | | Contact Angle | | | |
|---|---|---|---|---|---|---|---|---|
| | Yellow | Magenta | Cyan | Black | Yellow | Magenta | Cyan | Black |
| Example 2-1 | 2.40 | 3.97 | 3.53 | 3.03 | 108.1 | 98.8 | 98.8 | 94.8 |
| Example 2-2 | 1.68 | 2.91 | 2.21 | 2.25 | 104.5 | 95.2 | 92.8 | 88.6 |
| Reference Example 2-1 | 2.40 | 3.97 | 3.53 | 3.03 | 108.1 | 98.8 | 98.8 | 94.8 |
| Reference Example 2-2 | 2.40 | 3.97 | 3.53 | 3.03 | 108.1 | 98.8 | 98.8 | 94.8 |
| Reference Example 2-3 | 2.40 | 3.97 | 3.53 | 3.03 | 108.1 | 98.8 | 98.8 | 94.8 |
| Reference Example 2-4 | 2.40 | 3.97 | 3.53 | 3.03 | 108.1 | 98.8 | 98.8 | 94.8 |
| Reference Example 2-5 | 1.11 | 2.01 | 1.53 | 1.58 | 101.2 | 92.6 | 93.1 | 90.5 |
| Reference Example 2-6 | 0.87 | 1.61 | 1.23 | 1.28 | 99.8 | 90.1 | 89.6 | 88.4 |

TABLE 4

| Example No. | Results of Evalution | | | | |
|---|---|---|---|---|---|
| | Image Quality of Solid Part | Image Quality of Line Image Part | Unevenness | Surface Hardness | Stability of Solution |
| Example 2-1 | ○ | ○ | ○ | 200 g or more | ○ |
| Example 2-2 | ○ | ○ | ○ | 200 g or more | ○ |
| Reference Example 2-1 | ○ | ○ | ○ | 84 g | ○ |
| Reference Example 2-2 | ○ | ○ | x | 200 g or more | ○ |
| Reference Example 2-3 | ○ | ○ | ○ | 200 g or more | x |
| Reference Example 2-4 | ○ | ○ | ○ | 200 g or more | x |
| Reference Example 2-5 | Δ | Δ | ○ | 200 g or more | ○ |
| Reference Example 2-6 | x | X | ○ | 200 g or more | ○ |

It can be seen from the results in Table 4 that the samples in the examples of the present invention satisfy all of the evaluation items as compared with the samples in the reference examples.

Example 3-1

A transferred image was formed in the same manner as in Example 2-1 except that a styrene/acrylic acid copolymer (Joncryl 682, weight average molecular weight: 1,700, acid value: 238, manufactured by Johnson Polymer Co., Ltd.) was used in place of the acryl-based polymer used in the light-to-heat converting layer coating solution used in the preparation of the heat transfer sheet.

Example 3-2

A transferred image was formed in the same manner as in Example 2-1 except that a styrene/acrylic acid copolymer (Joncryl 690, weight average molecular weight: 15,500, acid value: 240, manufactured by Johnson Polymer Co., Ltd.) was used in place of the acryl-based polymer used in the light-to-heat converting layer coating solution used in the preparation of the heat transfer sheet.

Example 3-3

A transferred image was formed in the same manner as in Example 2-1 except that the dispersion of the matting agent of the light-to-heat converting layer coating solution was prepared without using the acryl-based polymer Joncryl 611 but Joncryl 611 was added separately in the preparation of the heat transfer sheet.

Reference Example 3-1

A transferred image was formed in the same manner as in Example 2-1 except that the acryl-based polymer used in the light-to-heat converting layer coating solution was not used in the preparation of the heat transfer sheet.

The reference example is an example for exhibiting the effect due to using or not using the acryl-based polymer.

The results of evaluation are shown in Table 5 below with the results of the following evaluation of the sample in Example 2-1.

TABLE 5

| | Constitution | | | | Evaluation | | |
|---|---|---|---|---|---|---|---|
| Example No. | Acryl-Based Polymer | Glass Transition Point (° C.) | Acid Value | Weight Average Molecular Weight | Solid Part | Line Image Part | b* of Solid Image C |
| Example 2-1 | Joncryl 611 | 50 | 53 | 8,100 | ○ | ○ | −48.6 |
| Example 3-1 | Joncryl 682 | 56 | 238 | 1,700 | ○ | ○ | −47.9 |
| Example 3-2 | Joncryl 690 | 102 | 240 | 15,500 | ○ | ○ | −49.1 |
| Example 3-3 | Joncryl 611 was added separately | 50 | 53 | 8,100 | ○ | ○ | −48.2 |
| Reference Example 3-1 | None | — | — | — | ○ | M, K....x Y, C....Δ | −44.2 |

The evaluation of images obtained in the above examples was carried out as follows.

In the evaluation of the image was carried out with the images of four color, but the evaluation in the hue was described by the value of cyan image in which the largest change of B* is appeared.

Evaluation of Image Quality

Using heat transfer sheets K, C, M and Y, the image quality of the solid part and the line image part of the transferred image obtained under each temperature-humidity condition was observed with an optical microscope. The time lag in the solid part was not observed in every surrounding condition with Examples 3-1 to 3-3, and the line definition was good, and transferred images having less dependency on the surrounding condition could be obtained. The evaluation was performed visually according to the following criteria.

Solid Part

○: Time lag in recording time and transfer failure were not observed.

Δ: Time lag in recording time and transfer failure were observed partially.

x: Time lag in recording time and transfer failure were observed all over the surface.

Line Image Part

○: The edge of the line image part was sharp and good definition was shown.

Δ: The edge of the line image part was jagged and bridging occurred partially.

x: Bridging occurred entirely.

Effect of the Invention

The present inventors are based on the membrane transfer technique, and as a result for solving novel problems in laser transfer technique and further improving the image quality, the present inventors have developed a heat transfer recording system by laser irradiation for DDCP which comprises an image-forming material of B2 size or larger having performances of transfer to actual printing paper, reproduction of actual dots and of a pigment type, output driver, and high grade CMS software. Thus, a system capable of sufficiently exhibiting the performances of the materials of high definition could be realized according to the present invention. Specifically, the present invention can provide proof corresponding to CTP system and contract proof substituting analog style color proof. By this proof, color reproduction which coincides with printed matters and analog style color proofs for obtaining the approval of customers can be realized. The present invention can provide DDCP system by using the same pigment materials as used in the printing inks, effecting transfer to actual paper and generating no moire. The present invention can also provide a large sized high grade DDCP (A2/B2 or more) capable of transferring to actual paper, capable of using the same pigment materials as used in the printing inks, and showing high approximation to printed matters. The system of the present invention is a system adopting laser membrane transfer, using pigment coloring materials and capable of transferring to actual paper by real dot recording. According to the multicolor image-forming system according to the present invention, even when laser recording by high energy using multi-beam two dimensional array under different temperature humidity conditions is performed, an image having good image quality and stable transfer density can be formed on the image-receiving sheet.

The entitle disclosure of each and every foreign patent application from which the benefit of foreign priority has been claimed in the present application is incorporated herein by reference, as if fully set forth herein.

While the invention has been described in detail and with reference to specific examples thereof, it will be apparent to one skilled in the art that various changes and modifications can be made therein without departing from the spirit and scope thereof.

What is claimed is:

1. A multicolor image-forming material which comprises an image-receiving sheet comprising a support having thereon a coating layer including at least an image-receiving layer, and a plurality of heat transfer sheets each comprising a support having coating layers including at least a light-to-heat converting layer and an image-forming layer, wherein the ratio of the optical density (OD) of the image-forming layer in each heat transfer sheet to the layer thickness, OD/layer thickness ($\mu$m unit), is 1.50 or more, the recording area of a multicolor image of the heat transfer sheet is a size of 515 mm or more multiplying 728 mm or more, the definition of a transferred image is 2,400 dpi or more, and the coating layer in the image-receiving sheet and/or the coating layers in each heat transfer sheet has at least one layer containing a dispersant and a matting agent having an average particle size of from 0.05 to 50 $\mu$m.

2. The multicolor image-forming material as claimed in claim 1, wherein the dispersant is a surfactant and/or a polymer.

3. The multicolor image-forming material as claimed in claim 1 or 2, wherein the average particle size of the matting agent is from 0.1 to 30 $\mu$m.

4. A method for manufacturing the multicolor image-forming material as claimed in claim 1, which comprises the steps of dispersing the matting agent in a dispersion medium with the dispersant in advance to prepare a coating solution containing the dispersed matting agent, coating and drying the prepared coating solution to form the layer containing the matting agent, to thereby obtain the multicolor image-forming material.

5. The method for manufacturing the multicolor image-forming material as claimed in claim 4, wherein the water content in the dispersion medium at dispersing the matting agent is 50% or less.

6. The multicolor image-forming material as claimed in claim 1, wherein any coating layer in the heat transfer sheet and/or the image-receiving sheet contains spherical fine particles having an average particle size of from 0.10 to 3.0 $\mu$m and a particle size distribution ($L_{25}/L_{75}$) of 2.0 or less.

7. The multicolor image-forming material as claimed in claim 6, wherein the spherical fine particles are amorphous fine particles.

8. The multicolor image-forming material as claimed in claim 6, wherein the spherical fine particles have an average particle size of from 1.1 to 3.0 $\mu$m.

9. The multicolor image-forming material as claimed in claim 6, wherein the spherical fine particles have a specific gravity of from 1.1 to 3.5 at 25° C.

10. The multicolor image-forming material as claimed in claim 6, wherein the spherical fine particles have a specific gravity of from 1.1 to 1.4 at 25° C.

11. The multicolor image-forming material as claimed in claim 1, wherein any coating layer in either the heat transfer sheet or the image-receiving sheet contains an acryl-based polymer having a glass transition point of from 10 to 120° C.

12. The multicolor image-forming material as claimed in claim 11, wherein the light-to-heat converting layer in the heat transfer sheet contains an acryl-based polymer having a glass transition point of from 10 to 120° C.

13. The multicolor image-forming material as claimed in claim 11, wherein the acid value of the acryl-based polymer is 300 or less.

14. The multicolor image-forming material as claimed in claim 11, wherein the acryl-based polymer has structure containing a styrene derivative moiety in the polymer molecule.

15. The multicolor image-forming material as claimed in claim 1, wherein the definition of a transferred image is 2,600 dpi or more.

16. The multicolor image-forming material as claimed in claim 1, wherein the ratio of the optical density (OD) of the image-forming layer in each heat transfer sheet to the layer thickness, OD/layer thickness ($\mu$m unit), is 1.80 or more.

17. The multicolor image-forming material as claimed in claim 1, wherein the recording area of a multicolor image is 594 mm multiplying 841 mm or more.

18. The multicolor image-forming material as claimed in claim 1, wherein the contact angle of the image-forming layer in each heat transfer sheet and the image-receiving layer in the image-receiving sheet with water is from 7.0 to 120.0°.

19. The multicolor image-forming material as claimed in claim 1, wherein the ratio of the optical density (OD) of the image-forming layer in each heat transfer sheet to the layer thickness, OD/layer thickness ($\mu$m unit), is 1.80 or more, and the contact angle of the image-receiving sheet with water is 89° or less.

20. The multicolor image-forming material as claimed in claim 1, wherein the ratio of the optical density (OD) of the image-forming layer in each heat transfer sheet to the layer thickness, OD/layer thickness ($\mu$m unit), is 2.50 or more.

21. A method for forming a multicolor image using the image-receiving sheet as claimed in claim 1 and four or more heat transfer sheets as claimed in claim 1 comprising the steps of superposing the image-forming layer in each heat transfer sheet and the image-receiving layer in the image-receiving sheet vis-a-vis, and irradiating the heat transfer sheet from the support side with laser beams and transferring the area of the image-forming layer subjected to laser beam irradiation onto the image-receiving layer in the image-receiving sheet, to thereby effect image-recording, wherein the image-forming layer in the laser beam irradiation area is transferred to the image-receiving sheet in a membrane state.

* * * * *